US008062151B2

(12) United States Patent
Boyd et al.

(10) Patent No.: US 8,062,151 B2
(45) Date of Patent: Nov. 22, 2011

(54) GOLF CLUB HEAD AND SYSTEM

(75) Inventors: Robert Boyd, Euless, TX (US); Gary G. Tavares, Southbridge, MA (US); John Thomas Stites, Weatherford, TX (US); Chia-Chyi Cheng, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 86 days.

(21) Appl. No.: 12/192,429

(22) Filed: Aug. 15, 2008

(65) Prior Publication Data

US 2010/0041490 A1 Feb. 18, 2010

(51) Int. Cl.
*A63B 53/06* (2006.01)

(52) U.S. Cl. ..... 473/334; 473/345

(58) Field of Classification Search ..... 473/345–346, 473/334

See application file for complete search history.

(56) References Cited

U.S. PATENT DOCUMENTS 1,213,382 A * 1/1917 Kent ..... 473/338
1,319,233 A * 10/1919 Mattern ..... 473/337
1,359,220 A 11/1920 Beamer
1,473,528 A * 11/1923 Tootle ..... 473/344
1,525,352 A * 2/1925 Garfield ..... 473/342
1,567,248 A * 12/1925 Dahlman ..... 473/342
1,638,916 A 8/1927 Butchart
1,780,625 A * 11/1930 Mattern ..... 473/324
4,021,047 A 5/1977 Mader
D262,049 S * 11/1981 Simmons ..... D21/752
D268,357 S * 3/1983 Mader ..... D21/733
4,438,931 A 3/1984 Motomiya
4,618,149 A * 10/1986 Maxel ..... 473/245
4,653,756 A 3/1987 Sato
4,681,322 A 7/1987 Straza et al.
4,749,197 A 6/1988 Orlowski
4,811,950 A * 3/1989 Kobayashi ..... 473/335
4,824,110 A * 4/1989 Kobayashi ..... 473/332

(Continued)

FOREIGN PATENT DOCUMENTS

CN 201067612 Y 6/2008

(Continued)

OTHER PUBLICATIONS

Sandia-developed Removable Adhesive Bonds and Detaches with Temperature Changes, Sandia National Laboratories News Release, Sep. 25, 2001. Printed Mar. 26, 2008: http://www.sandia.gov/media/NewsRel/NR2001/adhesive.htm.

(Continued)

*Primary Examiner* — Stephen L. Blau
(74) *Attorney, Agent, or Firm* — Banner & Witcoff, Ltd.

(57) ABSTRACT

A golf club head system and a golf club head for inclusion into a golf club are provided. The golf club head includes a main body member and a secondary body member. The main body member has a striking surface, a sole portion, a crown portion, and a rear face substantially opposed to the striking surface. The main body member defines an at least substantially enclosed main body cavity. The secondary body member is attached to the main body member and extends at least substantially over the entire rear face of the main body member. The golf club head system includes two or more secondary body members, each configured for interchangeable attachment to a main body member. Each secondary body member defines an internal concavity, has a different external shape, and has a different combination of center-of-gravity and moment-of-inertia characteristics.

19 Claims, 12 Drawing Sheets

U.S. PATENT DOCUMENTS

| | | | | |
|---|---|---|---|---|
| 5,190,291 | A | 3/1993 | Melvin | |
| 5,232,224 | A | 8/1993 | Zeider | |
| 5,255,918 | A | 10/1993 | Anderson et al. | |
| 5,421,577 | A * | 6/1995 | Kobayashi | 473/335 |
| 5,429,357 | A | 7/1995 | Kobayashi | |
| 5,505,453 | A | 4/1996 | Mack | |
| 5,509,660 | A | 4/1996 | Elmer | |
| 5,611,742 | A * | 3/1997 | Kobayashi | 473/345 |
| 5,632,695 | A * | 5/1997 | Hlinka et al. | 473/341 |
| 5,665,014 | A | 9/1997 | Sanford et al. | |
| 5,743,813 | A * | 4/1998 | Chen et al. | 473/329 |
| 5,776,011 | A | 7/1998 | Su et al. | |
| 5,935,020 | A | 8/1999 | Stites et al. | |
| 5,989,134 | A | 11/1999 | Antonious | |
| 6,004,224 | A * | 12/1999 | Tanaka | 473/297 |
| 6,159,109 | A | 12/2000 | Langslet | |
| 6,165,081 | A * | 12/2000 | Chou | 473/329 |
| 6,217,461 | B1 * | 4/2001 | Galy | 473/328 |
| 6,238,300 | B1 | 5/2001 | Igarashi | |
| 6,332,848 | B1 * | 12/2001 | Long et al. | 473/328 |
| 6,354,962 | B1 | 3/2002 | Galloway et al. | |
| 6,527,650 | B2 | 3/2003 | Reyes et al. | |
| 6,623,378 | B2 | 9/2003 | Beach et al. | |
| 6,663,506 | B2 * | 12/2003 | Nishimoto et al. | 473/345 |
| 6,695,715 | B1 * | 2/2004 | Chikaraishi | 473/329 |
| 6,739,983 | B2 | 5/2004 | Helmstetter et al. | |
| 6,758,763 | B2 * | 7/2004 | Murphy et al. | 473/342 |
| 6,825,315 | B2 | 11/2004 | Aubert | |
| 6,884,179 | B2 * | 4/2005 | Hoffman et al. | 473/312 |
| 6,890,269 | B2 | 5/2005 | Burrows | |
| 6,926,619 | B2 | 8/2005 | Helmstetter et al. | |
| 6,988,960 | B2 * | 1/2006 | Mahaffey et al. | 473/345 |
| 7,166,041 | B2 | 1/2007 | Evans | |
| 7,281,985 | B2 * | 10/2007 | Galloway | 473/246 |
| 7,285,060 | B2 | 10/2007 | Williams | |
| 7,306,527 | B2 * | 12/2007 | Williams et al. | 473/329 |
| 7,410,428 | B1 | 8/2008 | Dawson et al. | |
| 7,413,517 | B2 | 8/2008 | Butler, Jr. et al. | |
| 7,431,667 | B2 * | 10/2008 | Vincent et al. | 473/345 |
| 7,566,276 | B2 | 7/2009 | Billings | |
| 7,632,193 | B2 * | 12/2009 | Thielen | 473/334 |
| 7,878,924 | B2 * | 2/2011 | Clausen et al. | 473/335 |
| 2002/0065144 | A1 * | 5/2002 | Helmstetter et al. | 473/332 |
| 2003/0153401 | A1 | 8/2003 | Helmstetter et al. | |
| 2003/0232659 | A1 * | 12/2003 | Mahaffey et al. | 473/256 |
| 2004/0097299 | A1 | 5/2004 | Soracco | |
| 2004/0132541 | A1 | 7/2004 | Macllraith | |
| 2004/0229714 | A1 * | 11/2004 | Wahl et al. | 473/345 |
| 2004/0248667 | A1 * | 12/2004 | Cackett et al. | 473/349 |
| 2005/0026714 | A1 | 2/2005 | Stevens et al. | |
| 2005/0043112 | A1 | 2/2005 | Stevens et al. | |
| 2005/0049072 | A1 | 3/2005 | Burrows | |
| 2005/0239576 | A1 | 10/2005 | Stites et al. | |
| 2006/0040765 | A1 | 2/2006 | Sano | |
| 2006/0052174 | A1 | 3/2006 | Williams | |
| 2006/0100028 | A1 * | 5/2006 | Kuo | 473/334 |
| 2006/0128500 | A1 | 6/2006 | Tavares | |
| 2007/0037633 | A1 * | 2/2007 | Thielen | 473/346 |
| 2009/0088272 | A1 | 4/2009 | Foster et al. | |
| 2009/0143167 | A1 | 6/2009 | Evans | |
| 2009/0203465 | A1 | 8/2009 | Stites et al. | |
| 2009/0247319 | A1 | 10/2009 | Billings | |
| 2009/0270199 | A1 * | 10/2009 | Chen | 473/348 |
| 2010/0041495 | A1 | 2/2010 | North, III et al. | |

FOREIGN PATENT DOCUMENTS

| | | | |
|---|---|---|---|
| EP | 1752198 | A1 | 7/2006 |
| GB | 2418623 | A | 5/2006 |
| JP | 11178955 | A | 6/1999 |
| JP | 2005287679 | A * | 10/2005 |
| WO | 2008050074 | A1 | 5/2008 |
| WO | 2009102576 | A1 | 8/2009 |
| WO | 2009102693 | A1 | 8/2009 |

OTHER PUBLICATIONS

U.S. Appl. No. 11/774,513, filed Jul. 6, 2007 in the name of Tavares et al.

U.S. Appl. No. 11/774,519, filed Jul. 6, 2007 in the name of Thomas et al.

U.S. Appl. No. 11/774,522, filed Jul. 6, 2007 in the name of Stites et al.

U.S. Appl. No. 11/846,370, filed Aug. 28, 2007 in the name of Stites et al.

U.S. Appl. No. 12/177,778, filed Jul. 22, 2008 in the name of Thomas et al.

Invitation to Pay Additional Fees and, Where Applicable, Protest Fee, and Partial International Search Report, issued Nov. 5, 2009 in corresponding PCT Application No. PCT/US2009/053502.

International Search Report and Written Opinion issued Feb. 26, 2010 in corresponding PCT Application No. PCT/US2009/053503.

International Search Report and Written Opinion issued Feb. 9, 2010 in corresponding PCT Application No. PCT/US2009/053502.

Office Action issued Sep. 16, 2010 in related application U.S. Appl. No. 12/192,402.

Office Action issued Sep. 16, 2010 in child application U.S. Appl. No. 12/725,547.

Office Action issued Jan. 28, 2011 in related application U.S. Appl. No. 12/192,402.

Office Action issued Jan. 26, 2011 in child application U.S. Appl. No. 12/725,547.

Office Action issued Nov. 30, 2010 in related application U.S. Appl. No. 12/725,547.

Final Office Action issued Apr. 19, 2011 in related application U.S. Appl. No. 12/725,547.

Office Action issued Jun. 6, 2011 in related application U.S. Appl. No. 12/192,402.

* cited by examiner

GOLF CLUB HEAD AND SYSTEM

FIELD OF THE INVENTION

The present invention relates to golf club heads, and in particular, to a golf club head system including various interchangeable parts for providing a customer specific golf club head.

BACKGROUND

Longer distance golf clubs or drivers traditionally had heads made of wood (and were sometimes referred to as "woods"). However, wood, being a natural material, may be subject to unwanted variations or defects, and further requires a great deal of effort and expense to shape properly.

Thus, a new generation of longer distance golf clubs having hollow metal heads (and referred to as "metal woods" or "wood-type" golf clubs) was developed. The use of strong, lightweight metals in the heads has allowed for greater consistency in achieving performance characteristics and more efficient forming techniques.

More recently, metal woods have been formed with a metallic strike face portion and a non-metallic or partially non-metallic aft body portion. By using a hollow aft body portion and by reducing the density of the material used to form the aft body portion, the overall dimensions of the club heads could be increased while maintaining the same head weight. This allowed the heads of metal woods to be designed with increased striking surface area and increased moment of inertia characteristics.

During the game of golf, an individual swings the golf club such that the golf club head travels through a generally arcuate path. Upon impact with a golf ball, a portion of the inertia of golf club, and particularly the inertia of golf club head, is transferred to the golf ball, thereby propelling the golf ball (hopefully) toward an intended target. The position of a center of gravity of the head and the club head's path toward the ball have an influence upon whether the golf ball curves right, curves left, or follows a generally straight route. More specifically, the golf ball follows a generally straight route when the center of gravity is positioned behind the point of engagement of the ball with the striking plate and when the club head is traveling toward the intended target at the moment of impact with the ball. When the center of gravity is offset to one side of the point of engagement and/or when the club is traveling at an angle with respect to the intended path, however, the golf ball may follow a route that curves left or right. Similarly, the offset of the center of gravity of the golf club head above or below (or closer to or farther away from) the point of engagement has an influence upon whether the golf ball exhibits a boring or a climbing trajectory.

The center of gravity (or center of mass) of a golf club head is defined as an equilibrium point, i.e., a point at which the entire weight of the golf club head may be considered as concentrated so that, if supported at that point, the golf club head would remain in static equilibrium in any position.

It has been recognized that changing the position of the center of gravity of the golf club head for different golf clubs may compensate for the swing characteristics of certain golfers so as to correct or modify the route of the golf ball and thereby improve the golfer's game. For example, by moving the center of gravity lower and toward the rear of the golf club head, a golf shot will tend to have an increased loft upon impact between the club and ball. By moving the center of gravity higher and toward the rear of the golf club head, a golf shot will tend to have a decreased loft upon impact (a more "boring" trajectory).

Even more recently, metal woods have been developed whereby the aft body portion may be customized with a plurality of weights strategically placed within or on the aft body portion so as to vary the center of gravity and/or the moments of inertia of the golf club head. Various aft bodies may be pre-manufactured and available for later, final assembly with a specific golf club face. A golfer's swing could be analyzed and the golf club could be, at least partially, customized to account for various imperfections or foibles in the individual golfer's swing styles.

In a customizable club system many different combinations of elements (i.e., shafts, heads, head components, etc.) could be selected and permanently attached to one another to form the ultimate club. However, when buying a golf club, most golfers want to try out the actual, customized club that they will eventually use. To achieve a true feel for the club, the customizable components must be attached to one another as they would be under actual playing conditions. Thus, if a combination of elements is selected and the elements are permanently attached to each other to form the club (as they would be under actual playing conditions, so at to achieve a true feel for the club), but ultimately not chosen by the golfer, this customized and permanently assembled golf club could languish in the shop, possibly never being selected by any golfer. It would be desirable to have a more versatile component assembly system, whereby one could freely attach and then detach the different club elements from one another to try out a variety of club configurations, while at the same time achieving a true feel for the club. This would allow golfers to freely try many different combinations until the best combination for a particular golfer is achieved.

Further, it is possible that an individual golfer's swing style could improve or otherwise vary over time. In such case, a club customized to the golfer's earlier swing style may no longer be appropriate. It is also possible that, after a few initial rounds, the golfer may determine that the customized club does not accommodate his swing as much as would be desired. Even further, new technology or fashions may appear and a golfer may wish to keep current with the latest. A club having detachable elements would allow the golfer to replace the elements and modify or upgrade the club as desired.

It is an object of the present invention to provide a golf club head system that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The following presents a general summary of aspects of the invention in order to provide a basic understanding of at least some of its aspects. This summary is not intended as an extensive overview of the invention. It is not intended to identify key or critical elements of the invention or to delineate the scope of the invention. The following summary merely presents some concepts of the invention in a general form as a prelude to the more detailed description provided below.

The present invention is generally directed to a golf club head including a main body member and a secondary body member detachably attached to the main body member. By detachably attaching the secondary body member to the main body member, the secondary body member may be detached with only nominal forces and without damaging either the secondary body member or the main body member. This detachability provides the ability to easily replace one body member with another.

In one aspect, a golf club head includes a main body member having a striking surface, a striking surface frame and a hosel, and a hollow secondary body member detachably attached to the main body member. The main body member may further include a crown (or a portion of a crown) projecting rearwardly from a top portion of the striking surface frame and/or a sole member (or a portion of a sole member) projecting rearwardly from a bottom portion of the striking surface frame. The secondary body member may be detachably attached to the crown, the sole member and/or the striking surface frame of the main body member.

The secondary body member may be detachably attached to the main body member in various ways. In one aspect, the secondary body member is detachably attached to the main body member with an adhesive, particularly a liquefying epoxy. In another aspect, the secondary body member is detachably attached to the main body member with one or more mechanical elements. These mechanical elements may included threaded fasteners, elastically deformable elements, cam elements and/or plastically deformable, single-use elements. Further, the secondary body member may be both mechanically and adhesively detachably attached to the main body member.

In one aspect, a golf club head includes a main body member, having a striking surface and an at least substantially enclosed main body cavity, and a secondary body member. The main body member further includes a sole portion, a crown portion, and a rear face substantially opposed to the striking surface. The secondary body member is attached to the main body member and extends at least substantially over the entire rear face of the main body member.

In another aspect, the secondary body member and the main body member define an at least substantially enclosed second cavity therebetween, when the secondary body member is attached to the main body member.

The secondary body member and the primary body member may be detachably attached to one another with mechanical fastening elements, with removable adhesive or with a combination thereof.

In another aspect, a golf club having a golf club head with a secondary body member detachably attached to a main body member and a shaft and/or grip or handle member is provided.

In accordance with one aspect, a golf club head system is provided. The system includes a main body member, a first secondary body member detachably attached to the main body member, and at least one other secondary body member attachably interchangeable with the first secondary body member. In this system, each secondary body member may have a unique or different combination of center-of-gravity and moment-of-inertia characteristics and/or each secondary body member may have a unique or different external shape.

In accordance with a further aspect, a golf club head system includes two or more secondary body members, each configured for interchangeable attachment to a main body member. Each secondary body member has a unique or different external shape, and each secondary body member has a unique or different combination of center-of-gravity and moment-of-inertia characteristics. A means for detachably attaching each secondary body member, interchangeably, to the main body member is provided.

In another aspect, a golf club head system includes a main body member having a striking surface, a striking surface frame that extends at least partially around a perimeter of the striking surface, a crown (or at least a portion of a crown) projecting from a top portion of the striking surface frame, and a hosel. A first secondary body member configured for placement beneath the crown and configured for attachment to the main body member is provided. A second secondary body member configured for interchange with the first secondary body member and for interchangeable attachment to the main body member is also provided. A means for detachably attaching the first secondary body member to the main body member is also included in the system.

Substantial advantage is achieved by providing a golf club head and a golf club head system as described herein. In particular, certain preferred embodiments of the present invention can produce a robust, yet flexible, system for customizing golf club heads. Moreover, greater design flexibility is achieved due to the greater number of design parameters that can be varied, thereby leading to golf club heads that can be efficiently designed and customized for many different users. This great flexibility is achieved while reducing the inventory of golf club head components and of completed and assembled clubs.

These and additional features and advantages of the invention disclosed herein will be further understood from the following detailed disclosure of certain preferred embodiments.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

Figure 1:
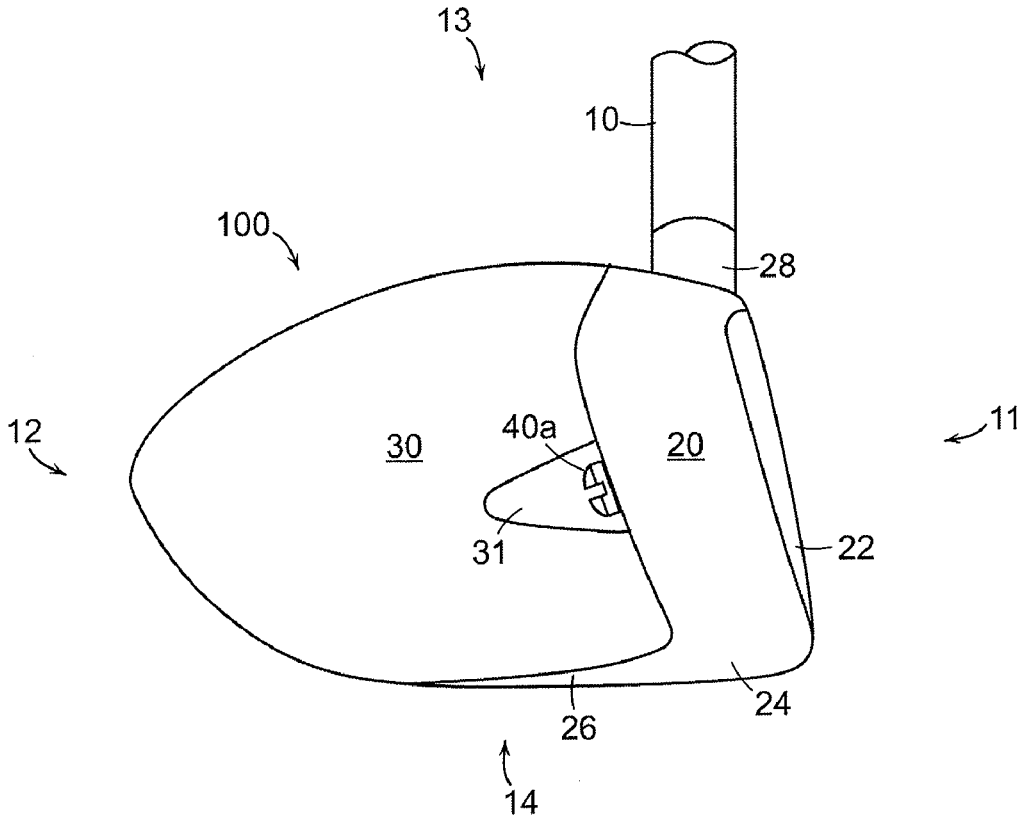
FIG. 1 is a toe side view of a golf club head according to an embodiment of the present invention.

The figures referred to above are not necessarily drawn to scale and should be understood to provide a representation of the invention, illustrative of the principles involved. Some features of the golf club heads depicted in the drawings may have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

In the following description of various example embodiments of the invention, reference is made to the accompanying drawings, which form a part hereof, and in which are shown by way of illustration various example structures, devices, systems, and environments in which aspects of the invention may be practiced. It is to be understood that other specific arrangements of parts, structures, example devices, systems, and environments may be utilized and structural and functional modifications may be made without departing from the scope of the present invention.

To assist the reader, this specification is broken into various subsections, as follows: Terms; General Description of Golf Club Heads According to Aspects of the Invention; Specific Examples of the Invention; and Conclusion.

A. TERMS

The following terms are used in this specification, and unless otherwise noted or clear from the context, these terms have the meanings provided below.

Unless otherwise stated or otherwise clear from the context below, directional terms used herein, such as "front," "rear," "side," "top," "bottom," etc., refer to directions relative to the golf club head itself. Thus, in the illustrated embodiment of FIG. 1, "front" refers to that portion of the head 100 that would lay adjacent the golf ball when the club is positioned for swinging, and "rear" or "aft" refers to that portion of the golf club head that is substantially opposite to the front. "Bottom" or "sole" refers to the portion of head 100 that lays adjacent the ground when the golf club is positioned for swinging, and "top" or "crown" refers to that portion of the golf club head 100 that is opposite to the bottom. "Hosel side" or "heel side" refers to the side of head 100 that is generally nearest the attachment of head 100 to a golf club shaft. "Toe side" refers to the side of head 100 that is opposite to the hosel side.

The term "detachably attached" refers to an attachment that is designed to be relatively easily undone and to prevent damaging or potentially damaging the attached parts during the detaching process. The term "releasably joined" may be used interchangeably with "detachably attached." A detachable attachment requires only nominal forces to detach the parts from one another.

A threaded fastener, which is designed to be readily unscrewed, is an example of a detachable attachment. An elastically deformable snap-lock fitting, which can be unsnapped without being destroyed, so as to allow for two parts to come apart, is another example of a detachable attachment. This is true, even if a special tool is required to unsnap the fitting. An adhesive joint using an adhesive that can be softened or melted at a relatively low temperature (such as by applying heat via a conventional hair drier, propane torch, etc.), such that the two attached parts slip apart without being damaged, is another example of a detachable attachment.

A detachable attachment does not cause damage to the parts that are attached to one another when the parts are detached. However, in one embodiment, a detachable attachment could encompass the destruction of an attachment element that is not an element of the parts that are attached. For example, the adhesive element in a releasable adhesive joint may not be capable of being reused and would therefore be considered to be only a single-use, replaceable attachment element (e.g., it may be cleaned off and replaced by fresh adhesive). As another example, two parts could be coupled together with a relatively soft pin that is press fit into relatively hard sockets of the two attached parts. To detach the parts, the pin could be punched out, and in the process destroyed. However, the sockets and the two attached parts would not be damaged. The attachment element, i.e., the pin in this example, is designed to be a single-use, replaceable item.

The opposite of a detachable attachment is a non-detachable attachment. A detachable attachment may be temporary (if it is detached) or permanent (if it is never detached). Thus, if the threaded fastener in the above example is not unscrewed, the two joined parts will remain permanently detachably attached to one other.

A brazed or welded joint would not be considered to be detachable, as detaching the parts would require the application of either excessive, potentially damaging heat, forces or machining to detach the welded elements from one another. Similarly, an adhesive joint that is designed for permanent bonding and that requires the application of excessive, potentially damaging heat to burn the adhesive off or that requires the application of excessive, potentially damaging prying force to pull the joint apart, would not be considered to be detachable. As another example, a riveted joint that generally requires alteration of the joined parts during the riveting process and that further requires unintended destruction of the rivet is not considered to be detachable.

In other examples, the design context and the context in which the attachment element is used must be taken into account. For example, a threaded fastener with a locking feature that requires considerable force (i.e., potentially damaging the joined parts) to unlock and which was designed to provide a permanent, non-detachable attachment would not be considered to be detachable. However, a threaded fastener having a locking feature that requires only nominal force to overcome and which was selected and designed, for example, to reduce play in the joint, may be considered to be detachable. Such a threaded fastener with a locking feature may be considered to be detachable even if the locking feature and/or the threaded fastener itself is destroyed during detachment.

As used herein, the terms "interchangeable" or "substitutable" refer to items that may be used in place of one another. In general, interchangeable items need not be identical to one another, and the interchangeability will be context driven. Thus, for example, a first component may be attachably interchangeable with a second component in that both the first and the second components may be configured for alternative attachment to a third component. However, the first component may have a different mass, a different center-of-gravity and/or different moments-of-inertia than the second component, and thus, in the context of mass characteristics, the second component would not be interchangeable with the first component. Even further, the second component may be attachably interchangeable with the first component in that both the first and the second components may be alternatively attachable to the third component, even though the details of the attachment might vary.

Interchangeable components are not necessarily detachably interchangeable. For example, two components are attachably interchangeable if each could be attached to a third component in place of the other. However, once the attachment of one of the components is formed with the third component, if the attachment is permanent, then even though the two components were attachably interchangeable, they are not detachably interchangeable. Only if the components are both detachably attachable and interchangeable are they detachably interchangeable.

B. GENERAL DESCRIPTION OF GOLF CLUB HEADS AND GOLF CLUB SYSTEMS ACCORDING TO ASPECTS OF THE INVENTION

In general, aspects of the present invention relate to systems for providing golf club heads, or other ball striking devices, that better control the mass properties of the individual golf club heads, thereby providing greater flexibility and customizability in the design of the overall golf club.

Golf club heads having a multi-component construction wherein at least one of the components is detachably attached to another are described herein. As a specific example in accordance with at least some aspects of this invention, a golf club head may include: a front body member (or a main body member) detachably attached to a rear body member (or to a secondary body member). Front body member (or main body member) includes a striking surface and further may include a striking surface frame, a sole portion, a crown portion, a rear face substantially opposed to the striking surface and/or a hosel.

The front or the main body members are typically formed as a unitary item from metal, although it may be formed of multiple sub-items and/or multiple materials, which are subsequently joined together. By way of non-limiting example, the striking surface could be formed of titanium or a titanium alloy separately from the frame, which could be formed of steel. Other materials such as aluminum, tungsten, nickel, alloys of various metals, graphite, polymers, plastics, composites, ceramics and/or combinations thereof could be used. Suitable methods and materials for forming the main body member will be apparent to persons of ordinary skill in the art, given the benefit of this disclosure (e.g., by welding a separate striking plate to a cup-shaped frame member, by forging, by pressing, by stamping, etc.).

The front body member may include a crown or a portion thereof projecting rearwardly from a top portion of the striking surface frame, or a sole member or a portion thereof projecting rearwardly from a bottom portion of the striking surface frame, or both in at least some examples of the invention. Optionally, if desired, the crown portion may extend over at least 25% of an overall front-to-back dimension of the golf club head. As additional examples, if desired, the crown portion may extend over at least 50% or even at least 80% of the overall front-to-back dimension of the golf club head.

Similarly, the rear or secondary body member may be formed as a single piece from a single material, or as multiple pieces subsequently joined to one another. Alternatively, the rear body member may be formed as a composite body, having multiple layers to build up the thickness. The rear body member may be hollow in order to reduce its weight and to allow a club designer to better distribute the club head's mass within the overall club head structure, e.g., to increase its moment-of-inertia without increasing its mass, to control the center of gravity location, etc. For example, the rear body member may be designed as a substantially shell-like structure that defines a concavity. Optionally, the rear body member may be designed to receive or carry weight elements (not shown) for customizing the mass distribution of the rear body member and the golf club head. These weights may be attached after manufacture of the rear body member or may be included within the rear body member, for example, between the layers of a composite body member.

According to one aspect of the invention, two or more rear or secondary body members may be provided for interchangeable attachment to a front or main body member. Each of the interchangeably attachable rear body members may have a unique combination of center-of-gravity and moment-of-inertia characteristics. Each of the interchangeably attachable rear body members may also have a unique external shape, thus allowing a golfer to not only customize the performance characteristics of the golf club, but also to customize the look of the golf club head. The various rear body members also may be colored differently and/or finished differently, to enable customization and change of the aesthetic appearance of the golf club head. A means for detachably attaching the rear body members to the main body member (e.g., a detachable attachment element) is provided for detachably attaching the interchangeable rear body members to the front body member.

Further, according to an aspect of the invention, a golf club head system has a front or main body member, a first rear or secondary body member detachably attached to the front body member, and at least one other rear or secondary body member that is attachably interchangeable with the first rear body member. The first rear body member is detachably attached. The other rear body member that is interchangeable with the first rear body member, may be detachably attachable or non-detachably attachable to the front body member.

The rear body member may be detachably attached to any part of the front body member, including, for example, to the striking surface, to a striking surface frame, to a crown portion, to a sole portion, to a rear surface, or to any combination thereof. In accordance with some illustrative embodiments of the invention, a means for detachably attaching a rear body member to a front body member may include an adhesive that melts or softens at relatively low temperatures. For example, the adhesive may be an epoxy adhesive having a debonding temperature less than 200° C., such that bonding and detaching parts becomes a matter of temperature change. One such known "removable" adhesive was developed at the Sandia National Laboratory and is disclosed in U.S. Pat. No. 6,825, 315. This removable adhesive liquefies (i.e., melts) and loses its bonding capability at relatively low elevated temperatures (approximately from 90 degrees C. to 130 degrees C., depending upon the exact formulation) and then rebonds when the temperature is lowered (approximately from 20-25 degrees C., i.e., room temperature, to 60 degrees C.). Minimal force is required to debond (or separate) the bonded elements when this liquifying adhesive has liquefied. This patent is entirely incorporated herein by reference.

In accordance with other illustrative embodiments of the invention, a means for detachably attaching a rear or secondary body member to a front or main body member may include one or more mechanical elements. In one embodiment, the mechanical elements may include one or more threaded fasteners. The individual fasteners could be longitudinally oriented in a front-to-rear direction, in a top-to-bottom direction, in a side-to-side direction or at an angle to any of these directions, depending upon the specific interface details, expected loads and/or accessibility concerns. By way of non-limiting example, threaded screws may fasten the rear body member to the front body member at the heel side and at the toe side of the club head. An additional threaded screw may fasten the rear body member to the front body member at a crown or sole member portion of the front body member. By way of another non-limiting example, one or more threaded screws may fasten the rear body member to the front body member at a rear surface of the front body member. Optionally, these threaded screws may be "captured" by the rear body member, such that they are easily accessible when the rear body member is being attached to the front body member. Further, optionally, the rear body member may include threaded inserts, bosses or captured nuts for receiving the threaded fasteners. As would be apparent to a person of ordinary skill in the art given the benefit of this disclosure, other mechanical fasteners and configurations of mechanical fasteners may be utilized.

As another example, the rear or secondary body member may be detachably attached to the front or main body member using mechanical elements that may include one or more elastically-deformable elements. By way of non-limiting example, an elastically-deformable mechanical fastening element may include a biasing element. By way of another non-limiting example, an elastically-deformable mechanical fastening element may include a snap-lock fastener. Such snap-lock fasteners could fasten the rear body member to the front body member at the heel side and at the toe side of the club head, at the top and at the bottom portions of the front body member, and/or at a rear surface of the front body member. Further, as another illustrative example, an elastically-deformable mechanical fastening element could be used in conjunction with one or more threaded fasteners. Elastically-deformable fastening elements could be made of any suitable material, such as metals and/or relatively hard plastics. A special tool, if necessary, could be used to temporarily deform the fasteners such that the joined members may be easily detached. If necessary, design features could be incorporated into the rear body member, the front body member or both to accommodate the use of a tool to assist in uncoupling the elastically-deformable elements. As would become apparent to a person of ordinary skill in the art given the benefit of this disclosure, other elastically-deformable mechanical fasteners may be used.

As even another example, the rear or secondary body member may be detachably attached to the front or main body member using mechanical elements that may include one or more plastically-deformable and/or single-use elements. By way of non-limiting example, a plastically-deformable mechanical fastening element may include a nylon plug inserted into a hole in the threaded portion of a fastener. Such a plastically-deformable element assists in retaining the threaded fastener in the threaded bore and reducing vibration. However, if the amount of plastic deformation of the plug is minimal, the threaded fastener will still be detachable with only nominal forces from the threaded bore. By way of another non-limiting example, a two-part shear pin may mechanically fasten the rear body member to the front body member. The shear pin may include an outer, plastically-deformable sleeve and an inner, non-deformable pin. This pin could join a lug-and-clevis arrangement of the rear body/front body members. Specifically, the lug and the clevis of the rear body/front body members could be aligned; the outer, plastically-deformable sleeve could be inserted into to the bores of the aligned lug-and-clevis; and then the inner, non-deformable pin could be inserted into the sleeve. The insertion of the inner pin could cause the outer sleeve to deform, thereby providing a slip and vibration free joint. To detach the rear body member from the front body member, the inner pin would be pulled (or pushed) from the bores, thereby allowing the deformed outer sleeve to be removed from the bores. As would be apparent to a person of ordinary skill in the art given the benefit of this disclosure, other plastically-deformable mechanical fasteners may be used.

Further, without departing from the invention, a means for detachably attaching a rear or secondary body member to a front or main body member may include both mechanical elements and adhesive elements.

Other club head components may be provided in a club head structure without departing from the invention. For example, at least some golf club heads in accordance with examples of this invention may include weight members. Optionally, the weight members could be movable and/or capable of being relocated to a variety of locations on the golf club head, thereby providing multiple weighting arrangements with respect to the club head structure.

The various parts of the golf club head may be made from any suitable or desired materials without departing from this invention, including steel (including stainless steel), titanium alloys, magnesium alloys, aluminum alloys, carbon fiber composite materials, glass fiber composite materials, carbon pre-preg materials, polymeric materials, and the like. Further, the various parts may be produced in any suitable or desired manner without departing from the invention, including casting, forging, molding (e.g., injection or blow molding), pressing, stamping, etc. Examples of polymeric materials that may be included in various parts of a club head structure include: thermoplastics (e.g., those suitable for use in injection or blow molding processes, such as thermoplastic polyurethanes, etc.), nylons, polyesters, and the like. If desired, the polymeric materials may also include metals or metal alloy components, e.g., to affect strength and/or to control weight or density. As would be apparent to a person of ordinary skill in the art given the benefit of this disclosure, materials other than those specifically identified above as non-limiting examples may be used for the various parts of the golf club head without departing from this invention.

If the front or main body member is not formed as a unitary structure, then the various parts of the front body member may be held together as an integral structure in any suitable or desired manner, including by way of non-limiting examples, using mechanical connectors, adhesives, cements, welding, and the like. Similarly, if the rear or secondary body member is not formed as a unitary structure, then the various parts of the body member may be held together as an integral structure in any suitable or desired manner, including by way of non-limiting examples, using mechanical connectors, adhesives, cements, welding, and the like. Additionally, as would become apparent to a person of ordinary skill in the art given the benefit of this disclosure, the various parts of the front body member and/or the rear body member, if any, may optionally be constructed from different materials, without departing from this invention.

Aspects of this invention also relate to golf clubs that include golf club head structures described above. Such clubs may include, for example, a club head of the type described above and a shaft extending from the head. The shaft may be attached to the head in any suitable or desired manner, including in conventional manners known and used in the art, such as via adhesives, cements, welding, soldering, mechanical connectors (such as threads, retaining elements, or the like), releasable connections, etc. Further, the shaft could be detachably attached to the golf club head via a liquefying adhesive, as would be apparent to a person of ordinary skill in the art given the benefit of this disclosure. The shaft may be made from any suitable or desired materials, including conventional materials known and used in the art, such as graphite based materials, other composite materials, steel materials (including stainless steel), aluminum materials, other metal alloy materials, and the like.

Also, as is conventional, a grip element or other handle member may be attached to and/or extend from the shaft. Any desired grip materials may be used without departing from this invention, including rubber materials, leather materials, materials including cord or other fabric material embedded therein, polymeric materials, and the like. The grip element may be attached to the shaft in any suitable or desired manner, including in conventional manners known and used in the art, e.g., using adhesives or cements. For structures including a separate handle member extending from the shaft, the handle member may be connected to the shaft, directly or indirectly, in any suitable or desired manner, such as via welding, soldering, adhesives, mechanical connectors (such as threads, retaining elements, etc.), or the like.

While specific dimensions, characteristics, and/or ranges of dimensions and characteristics may be used for a given club head structure (such as the ranges described in U.S. Published Patent Application No. 2005/0239576 A1, entitled "Golf Clubs and Golf Club Heads", filed by Stites et al., published Oct. 27, 2005 and incorporated by reference herein in its entirety), those skilled in the art will recognize that these dimensions and ranges are simply examples that may be used in at least some example club head structures of the invention. Many variations in the ranges and the specific dimensions and characteristics may be used without departing from this invention, e.g., depending on the type of club, user preferences, user swing characteristics, and the like, and these features may be controlled depending on the characteristics of the rear body member and/or the front body member. For example, various dimensions and/or characteristics may be achieved (such as various loft angles, face angles, head weights, lie angles, center of gravity angles, inset distances, lengths, breadths, heights, face thicknesses, crown thicknesses, sole thicknesses, body member wall thicknesses, hosel diameters, volumes, bulge radii, roll radii, body densities, etc.), e.g., depending on whether the golf club head is a driver, a 2-wood, a 3-wood, a 4-wood, a 5-wood, a 7-wood, a 9-wood, a wood-type hybrid club, etc. Also, various dimensions and/or characteristics may be provided to suit a user's preferences and/or swing characteristics; to provide the desired launch angle, carry distance, and/or other characteristics for the club; etc. Additionally, various different shaft characteristics (such as stiffness, flex point, kick point, etc.) may be used to further allow change and control over the club's and the club head's feel and characteristics.

Golf club heads in accordance with examples of this invention may use the club head design and/or geometry to produce other desired club head characteristics. For example, in some club head structures in accordance with this invention, the front body member of the club head will be designed such that the club head will have a larger head and/or face length (e.g., heel to toe) relative to the club head's depth or breadth (e.g., front to back) and a "squared" structure, which results in a club head that is more torsionally stable (i.e., more resistant to twisting), thereby producing a more consistent, reliable, and/or straight golf ball flight. Golf club heads and golf clubs in accordance with at least some of these example aspects of the invention may include a front or main body member and/or a rear or secondary body member sized so as to provide a club head body having an overall club head length dimension L of at least 4.5 inches, at least 4.6 inches, at least 4.7 inches, at least 4.8 inches, or even at least 4.9 inches, and a ratio of an overall club head breadth dimension to the overall club head length dimension of 0.9 or more and 1 or less. Club heads in accordance with at least some examples of this invention may have a ratio of club head breadth to club head length of at least 0.94, at least 0.95, at least 0.96, at least 0.97, or even at least 0.98.

In golf club heads in accordance with at least some examples of this invention, the front or main body member and/or the rear or secondary body member may be sized such that the overall club head breadth B dimension may be at least 4.2 inches, at least 4.3 inches, at least 4.4 inches, at least 4.5 inches, at least 4.6 inches, at least 4.7 inches, at least 4.8 inches, or even at least 4.9 inches. As with the examples described above, the club head body according to at least some examples of this aspect of the invention may be dimensioned such that the overall club head length dimension L is at least 4.7 inches, at least 4.8 inches, or even at least 4.9 inches, and/or such that the overall club head body size is 500 $cm^3$ or less, 470 $cm^3$ or less, or even 460 $cm^3$ or less. In some examples, the interchangeable rear or secondary body member will be sized and shaped such that the overall club head body size or volume will be at least 350 cc, at least 400 cc, at least 420 cc, or even at least 450 cc.

Specific examples of the invention are described in more detail below. The reader should understand that these specific examples are set forth merely to illustrate examples of the invention, and they should not be construed as limiting the invention.

C. SPECIFIC EXAMPLES OF THE INVENTION

The various figures in this application illustrate examples of golf club heads, golf club head systems, and golf club head components useful in examples of this invention. When the same reference number appears in more than one drawing, that reference number is used consistently in this specification and the drawings to refer to the same part throughout.

At least some example embodiments of golf club heads according to this invention relate to "wood-type" golf club heads, e.g., useful for drivers, fairway woods, utility or hybrid type clubs, or the like. Such club head structures typically include a multiple piece construction and structure.

The present invention may be embodied in various forms. FIGS. 1-5 are views illustrating certain features of an embodiment of a golf club head 100. Head 100 includes a main body member 20 connected to a secondary body member 30. Typically, head 100 is connected to a golf club shaft 10 (see FIG. 1), thereby forming a complete golf club.

Head 100 includes a front 11, a rear 12 atop 13, a bottom 14, a heel side 15, and a toe side 16.

In the illustrated embodiment of FIGS. 1 through 5, main body member 20 (or front body member) is generally cup-shaped (i.e., formed as a substantially relatively thin-walled shell and defining an inner concavity) and includes striking surface 22 (also referred to as a face plate), a striking surface frame 24, and a sole portion 26. In this embodiment, main body member 20 is further illustrated with an external hosel 28 for attaching golf club shaft 10 to head 100.

Striking surface 22 provides a contact area for engaging and propelling a golf ball in an intended direction. Striking surface 22 need not have a flat strike surface. For example, the strike surface may include horizontal grooves (not shown). Striking surface 22 also may be curved, e.g., to include "bulge" and "roll" characteristics, as are commonly included in golf club head structures.

Striking surface frame 24 is connected to striking surface 22. Frame 24 may be integrally formed with or subsequently joined to striking surface 22 (e.g., by welding). In the illustrated embodiment, frame 24 extends around the perimeter of striking surface 22 and further extends in a depth direction toward the rear portion 12 of head 100. In one example embodiment, frame 24 may be formed of titanium metal or alloy (as is known and used in the art), may have a thickness ranging from approximately 0.01 inches to approximately 0.25 inches, and a depth ranging from approximately 0.1 inches to 2 inches (exclusive of any crown or sole portion that may be present). The thickness and depth contours of frame 24 need not be constant. Further, frame 24 may extend only partially around the perimeter of striking surface 22. Even further, frame 24 need not be continuous.

Sole portion 26 is located on the bottom portion 14 of head 100. Sole portion 26 projects from a lower edge of frame 24, thereby extending toward the rear portion 12 of head 100. Sole portion 26 may be integrally formed with or subsequently joined to frame 24. In one example embodiment, sole portion 26 may be formed of titanium metal or alloy, steel, or other material, may have a thickness ranging from approximately 0.01 inches to approximately 0.25 inches, and a side-to-side width ranging from approximately 1 inch to 5 inches. The thickness and width contours of sole plate 26 need not be constant. Sole portion 26 may extend all the way to the rear edge of head 100. In one embodiment, sole portion 26 extends more than halfway across the front-to-rear length of head 100.

Main body member 20 may include hosel 28 (shown in FIG. 1). Hosel 28 provides an attachment interface for attaching a golf club shaft 10 to golf club head 100. Hosel 28 is located where the heel side portion 15 and top portion 13 of head 100 come together. Additionally, hosel 28 is typically located closer to the front portion 11 than to the rear portion 12. Hosel 28 may be integrally formed with main body member 20. Alternatively, hosel 28 (or at least some portions thereof) may be formed separately from the rest of main body member 20 and subsequently joined thereto. In FIG. 1, hosel 28 is shown as projecting from frame 24. In another possible configuration, the hosel could be formed as a bore located within main body member 20 (e.g., a "neckless" or interior hosel configuration).

Figure 5:
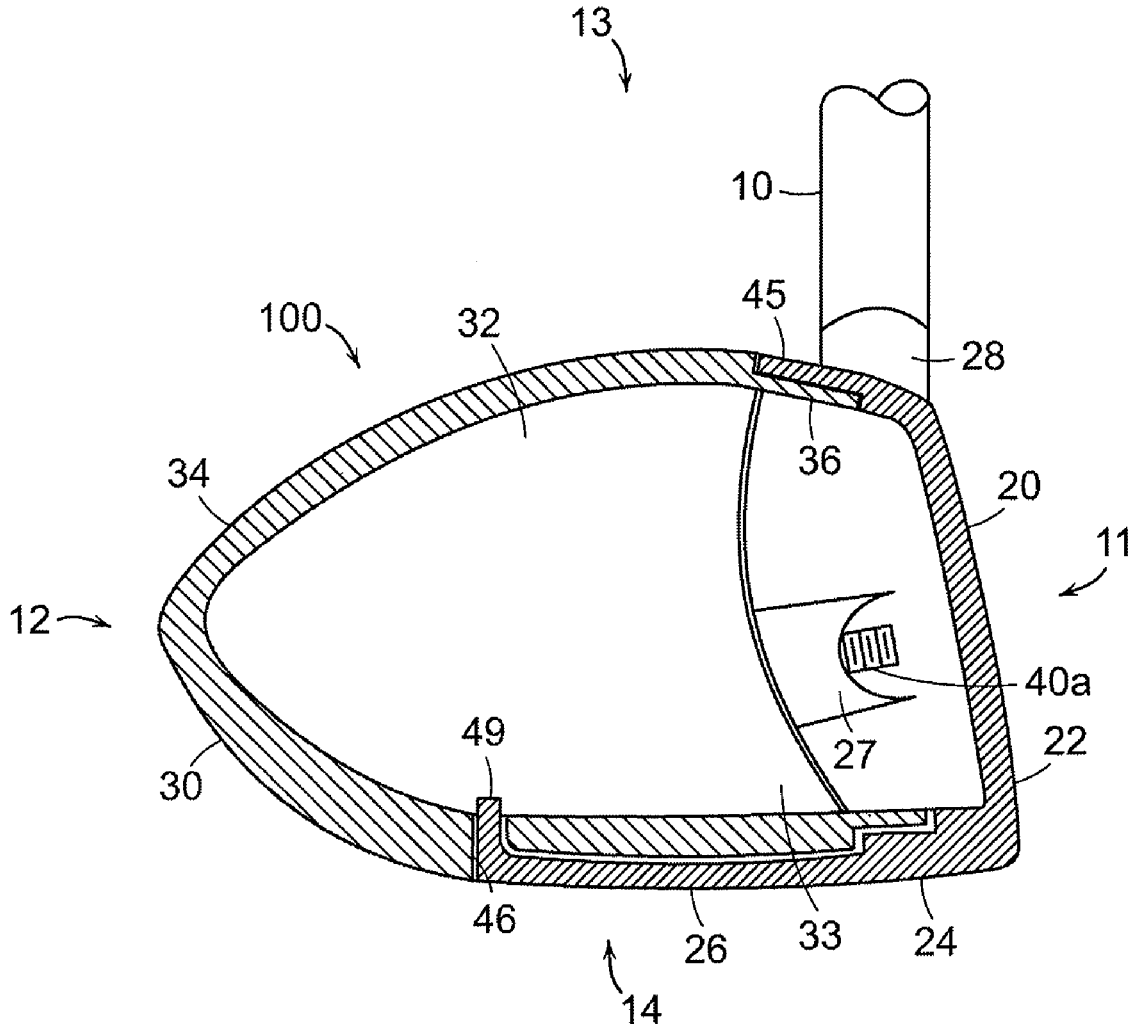
FIG. 5 is a cross-section view taken at V-V in FIG. 3.

Secondary body member 30 (or rear body member) is detachably attached to main body member 20. In one aspect and as embodied in FIGS. 1-5, secondary body member 30 is formed as a hollow body. As best shown in FIG. 5, secondary body member 30 includes an internal concavity 32 at least partially enclosed by walls 34. Secondary body member 30 further includes an opening that faces main body member 20 and is opposite to rear portion 12 of secondary body member 30. In the illustrated embodiment, secondary body member 30 includes a perimeter flange 36 for complementary insertion into a perimeter flange 45 of main body member 20. When secondary body member 30 is attached to main body member 20, a closed or substantially closed internal cavity 33 is formed within club head 100. Alternatively, if desired, the perimeter flange 36 of secondary body member 30 may overlay the perimeter member 45 of main body member 20. Optionally, if desired, a polymeric material (e.g., rubber, polytetrafluoroethylene, or other material), such as a gasket, may be provided at the joint between secondary body member 30 and main body member 20 (e.g., fully or partially around the perimeter of the joint) to damped noise or vibration or reduce rattling.

Figure 2:
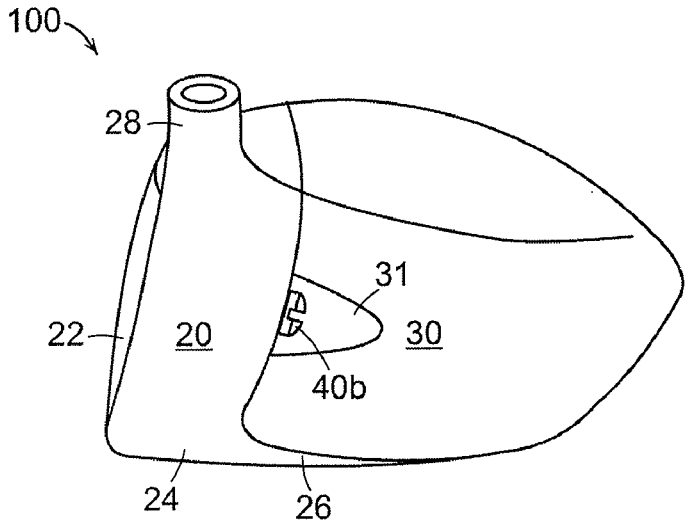
FIG. 2 is a heel side view of the golf club head according to the embodiment of FIG. 1, except without the golf club shaft.
Figure 3:
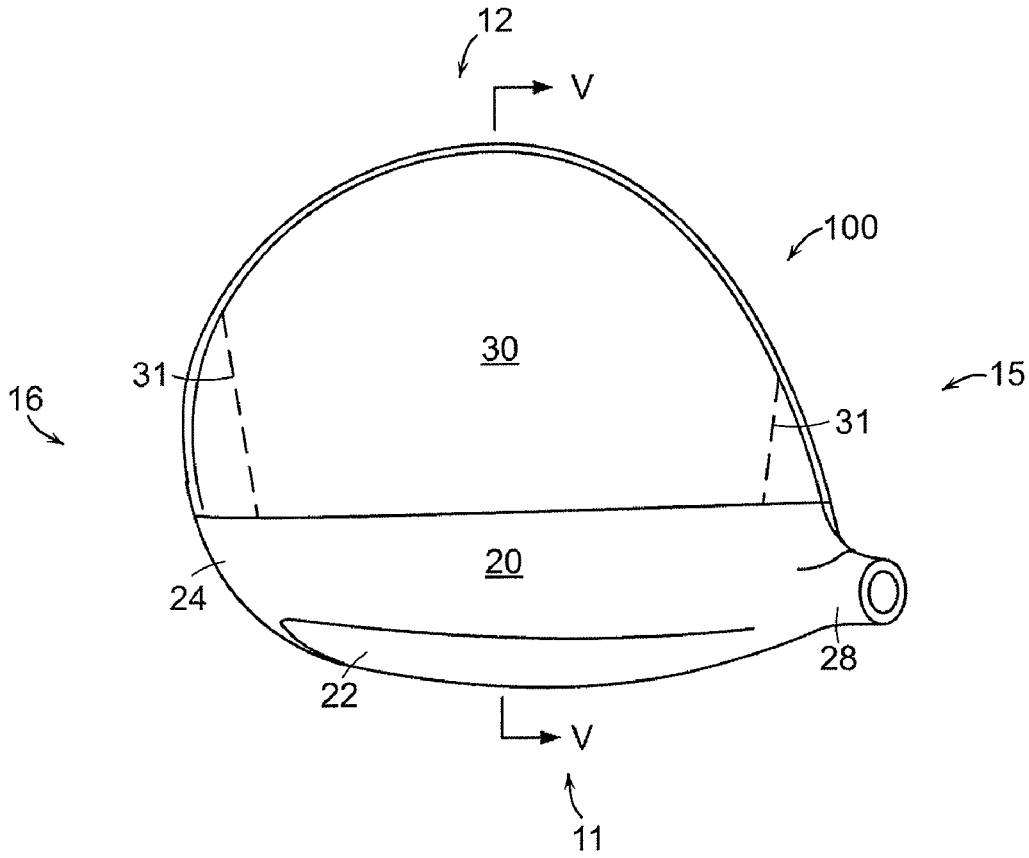
FIG. 3 is a top view of the golf club head according to the embodiment of FIG. 2.
Figure 4:
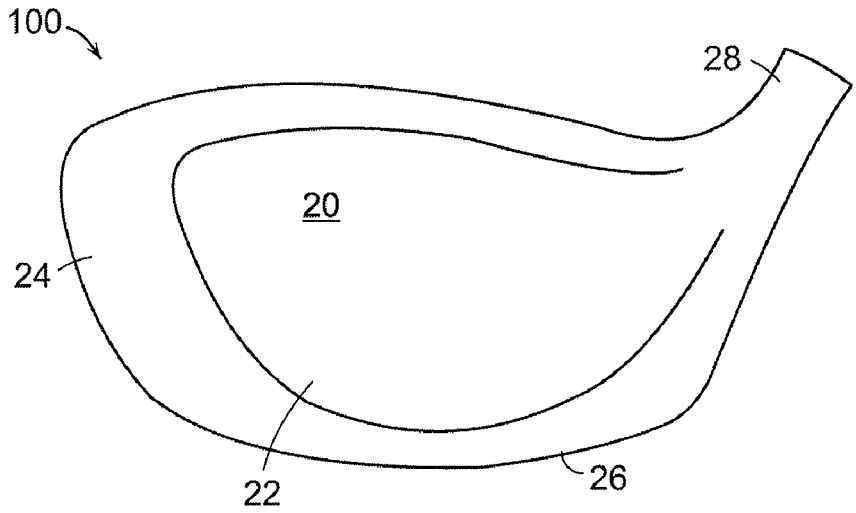
FIG. 4 is a front view of a golf club head according to the embodiment FIG. 2.

In the embodiment of FIGS. 1-5, secondary body member 30 is removably and replaceably coupled to main body member 20 by threaded fasteners 40. As shown in FIGS. 1 and 2, one threaded fastener **40*a* is located on the toe side of head 100 and the other threaded fastener 40*b* is located on the heel side. Each of these threaded fasteners has a longitudinal axis that is oriented approximately perpendicular to the plane of striking surface 22. Secondary body member 30 includes countersunk portions 31 to allow for insertion and removal of threaded fasteners 40 at the proper angle. As best shown in FIG. 5, in this particular embodiment, for each fastener, main body member 20 includes a boss 27 attached to or formed at an inner side wall. The end of the threaded portion of fastener 40*a* extends into and/or through boss 27**.

As presented above, main body member 20 of the embodiment of FIGS. 1-5 includes sole portion 26. An elastically-deformable element couples secondary body member 30 to sole portion 26 in this example structure. Specifically, the rearward-most end of sole portion 26 includes a tab 49. Tab 49 is designed to slide into a slot 46 defined in secondary body member 30, thereby coupling sole portion 26 to the bottom of secondary body member 30. Tab 49 is elastically deformable, thereby facilitating the insertion of tab 49 into slot 46, and further providing a biasing of secondary body member 30 relative to main body member 20. Biasing may be used to remove unwanted play between the two detachably attached members. A person of ordinary skill in the art will appreciate that other fastening mechanisms may be used to detachably attach sole portion 26 to secondary body member 30, given the benefit of this disclosure.

Figure 6:
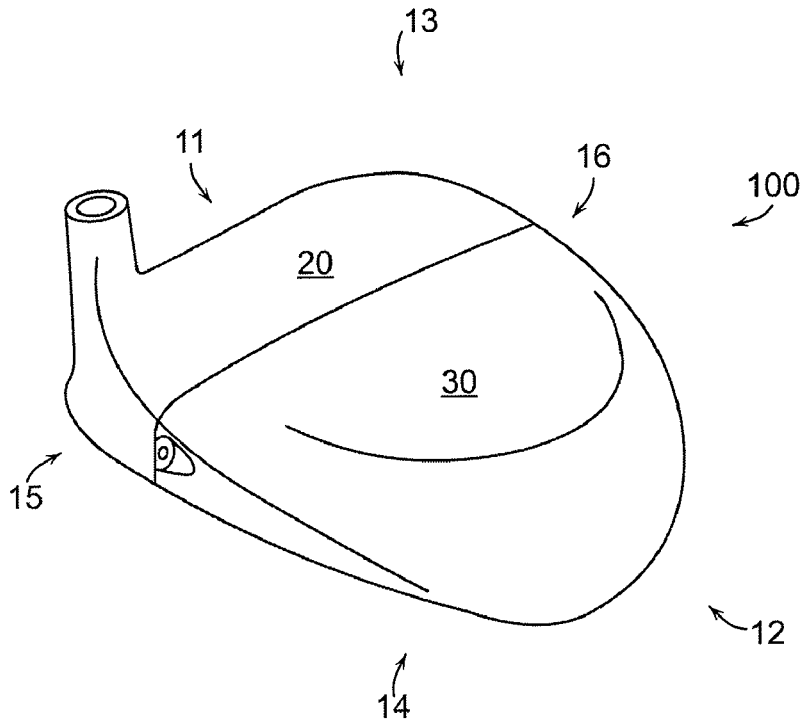
FIG. 6 is a perspective view of a golf club head according to another embodiment of the present invention.
Figure 7:
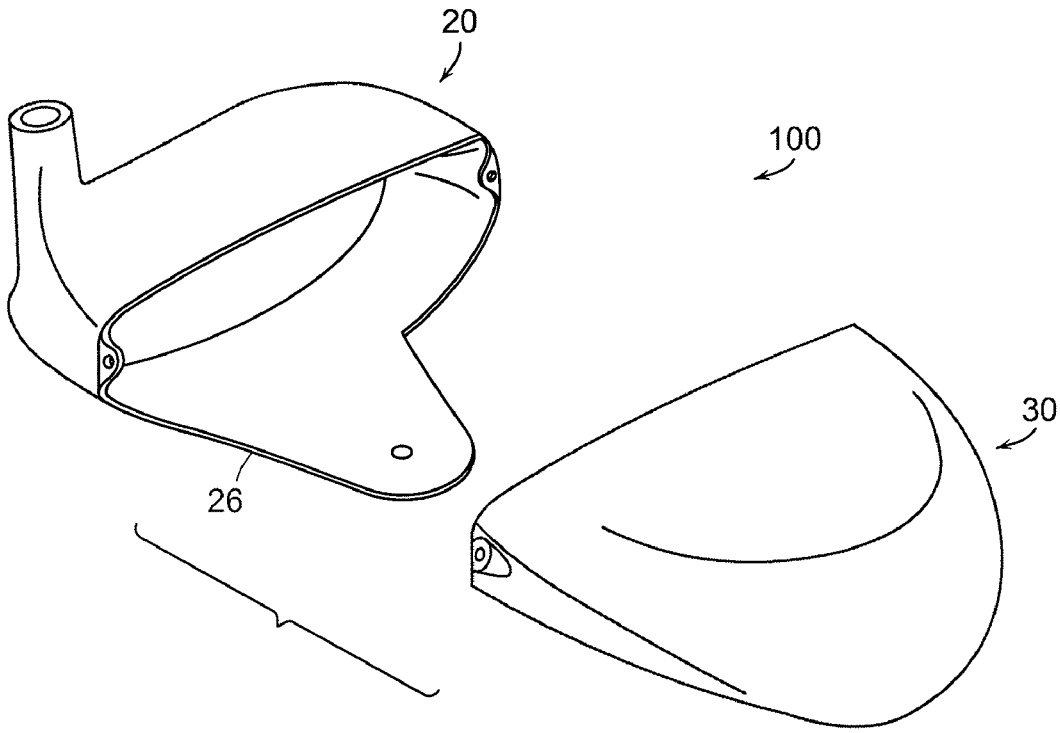
FIG. 7 is an exploded perspective view of the golf club head according to the embodiment of FIG. 6.

In the embodiment of FIGS. 6 and 7, sole plate 26 includes a throughhole at its rearward-most end, so that sole portion 26 may be fastened to secondary body member 30 with a threaded fastener (e.g., threaded into a boss or an attached nut member included with the body member structure).

Figure 8:
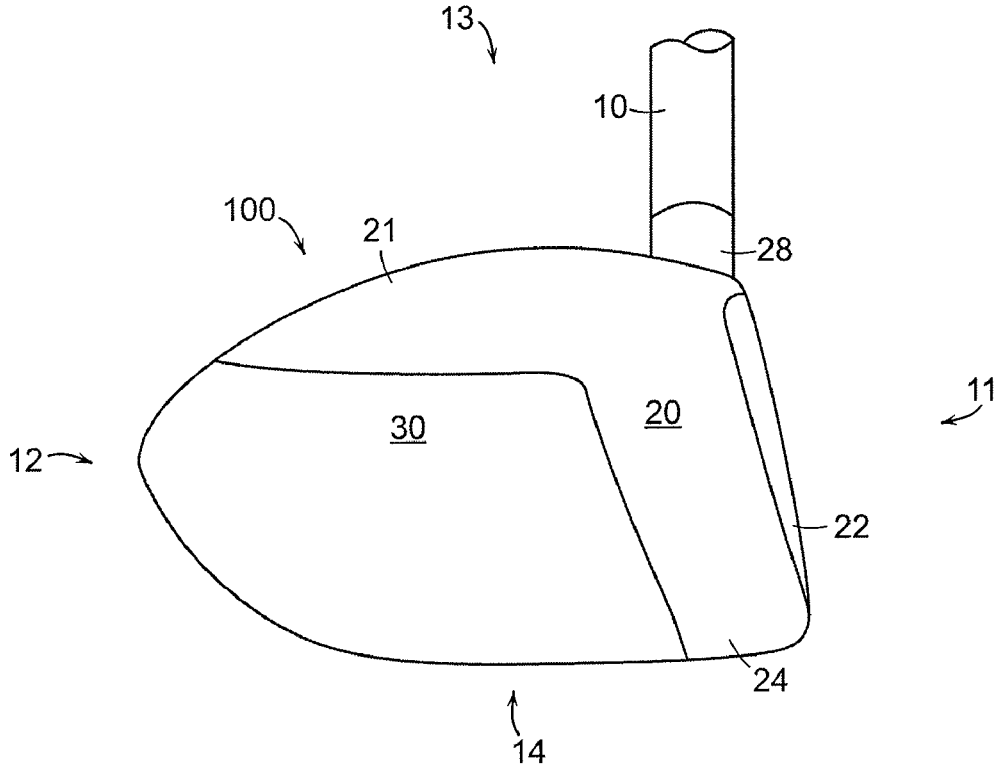
FIG. 8 is a toe side view of a golf club head according to another embodiment of the present invention.
Figure 9:
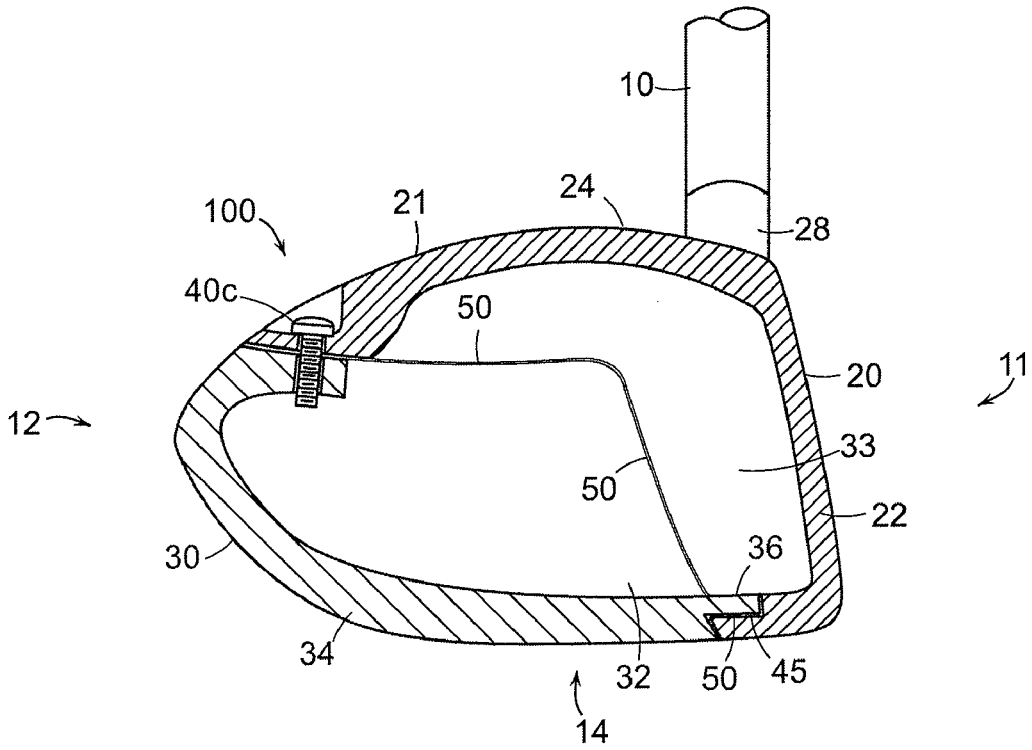
FIG. 9 is a cross-section view of the golf club head according to the embodiment of FIG. 8.

In the embodiment of FIGS. 8 and 9, main body member 20 includes a crown portion 21. Crown portion 21 projects rearwardly from a top portion of striking surface frame 24. In this particular embodiment, crown portion 21 is integrally formed with frame 24. At the rearward-most end of crown portion 21, a threaded fastener **40*c* is provided to detachably attach secondary body member 30 to main body member 20**. Additional fasteners may be provided at other locations, if desired.

Secondary body member 30 may include a concavity 32 partially enclosed by walls 34. The upper portion of a rear wall of secondary body member 30 extends toward striking surface 22 and provides a platform for receiving the threaded portion of fastener **40*c*. At the bottom portion of secondary body member 30, a flange 36 overlaps a complementary flange 45 formed in the bottom portion of frame 24. In this embodiment, a layer of removable, liquefiable adhesive 50 is located between the two flanges 45 and 30. Further, a layer of removable, liquefiable adhesive 50 extends up and around the side walls and crown portion of main body member 20 where it interfaces with secondary body member 30. To detach secondary body member 30 from main body member 20, fastener 40***c* is removed and then the removable adhesive is heated until it melts. Upon liquefaction of the adhesive, secondary body member 30 is debonded from main body member 20 such that secondary body member 30 easily slides apart from main body member 20.

Figure 10:
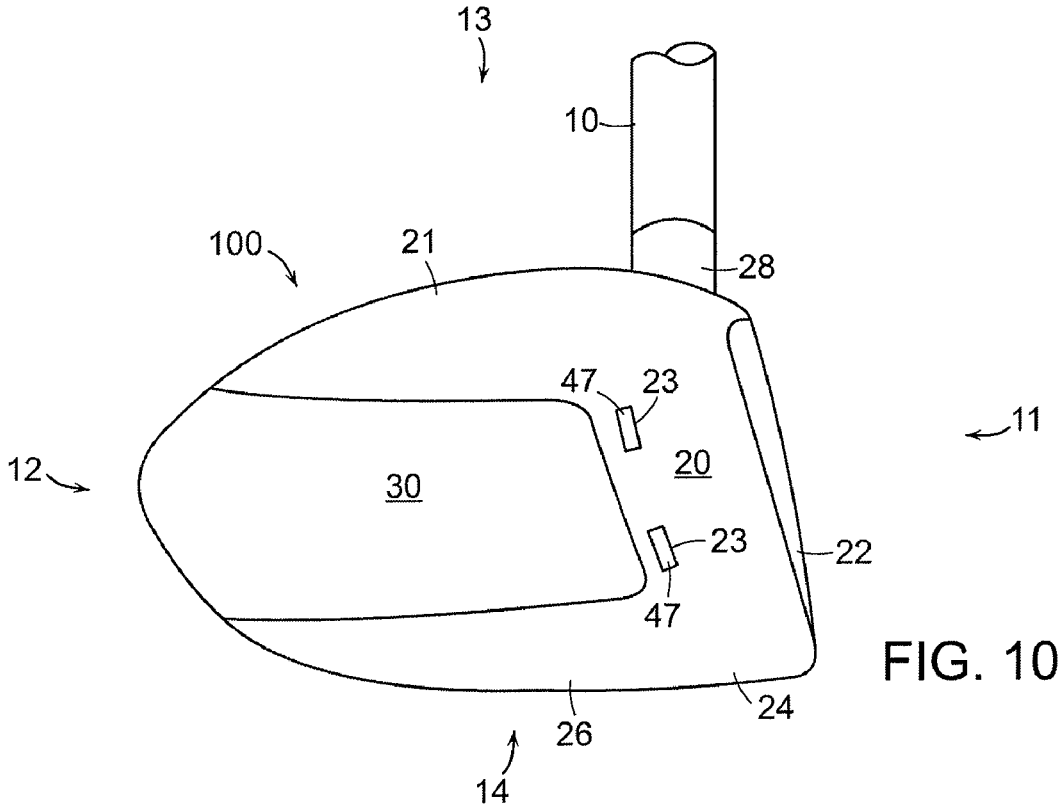
FIG. 10 is a toe side view of a golf club head according to yet another embodiment of the present invention.
Figure 11:
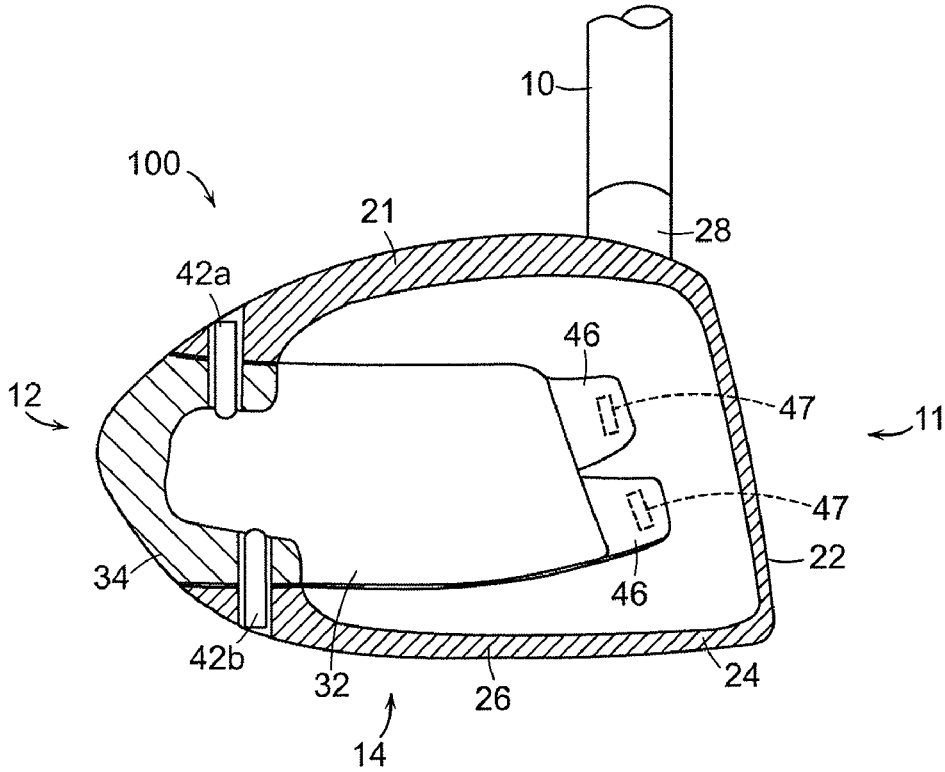
FIG. 11 is a cross-section view of the golf club head according to the embodiment of FIG. 10.

In the embodiment of FIGS. 10 and 11, main body member 20 includes a crown portion 21 and a sole portion 26. Secondary body member includes a concavity 32 partially enclosed by walls 34. In this embodiment, walls 34 form a roughly U-shaped enclosure of concavity 32, with two side walls extending forwardly from a rear wall portion. Crown portion 21 projects rearwardly from a top portion of striking surface frame 24. Sole portion 26 projects rearwardly from a bottom portion of striking surface frame 24. In this particular embodiment, both crown portion 21 and sole portion 26 are integrally formed with frame 24.

As best shown in FIG. 11, at the rearward-most end of crown portion 21, a through hole is provided to accept a portion of pin 42*a*. A corresponding through hole for accepting a different portion of pin 42*a* is provided in a top, rear portion of secondary body member 30. At the rearward-most end of sole portion 26, a through hole is provided to accept a portion of pin 42*b*. A corresponding through hole for accepting a different portion of pin 42*b* is provided in a bottom, rear portion of secondary body member 30. Pins 42*a*, 42*b* detachably attach the rear portion of secondary body member 30 to the rear portions of main body member 20 (i.e., the rear portion of crown portion 21 and the rear portion of sole portion 26). In this particular embodiment, pins 42*a* and 42*b* are elastically-deformable roll or spring pins. Optionally, in another embodiment, pins 42*a* and 42*b* may include a plastically-deformable sleeve and a central (essentially) non-deformable pin.

At the forward-most ends of secondary body member 30, a pair of tabs 46 is provided in this particular embodiment. Tabs 46 may be formed of the same material as the rest of secondary body member 30, and further, may be formed integrally with secondary body member 30. In the attached configuration, tabs 46 lie alongside the inner surface of a side wall of main body member 20. Each tab 46 includes a projection 47 that extends outwardly toward the side wall of main body member 20 and engages an aperture 23 of main body member 20. FIG. 11 shows a dashed outline of projections 47, as they are located on the opposite side of tabs 46 in this view.

To detach secondary body member 30 from main body member 20, pins 42*a*, 42*b* are driven into cavity 31 with a pin driver. Then, projections 47 are disengaged from apertures 23 by either using a tool to push projections 47 inward or by squeezing the side walls of secondary body member 30 toward one another. Of course, if desired, the various club head components illustrated in FIGS. 10 and 11 may be connected using other types of connectors, such as the threaded mechanical connectors described above.

It is to be appreciated that any number of fastening elements can be provided on the golf club head and that the location and orientation of the fastening elements described herein are merely illustrative. Other suitable methods for detachably attaching secondary body member 30 to main body member 20 will be apparent to persons of ordinary skill in the art, given the benefit of this disclosure.

In the embodiment shown in FIGS. 12 through 16, main body member 20 includes a striking surface 22, a sole portion 26, a crown portion 21, and a rear face 25 substantially opposed to striking surface 22. In this embodiment, the main body member defines an at least substantially enclosed main body cavity 29.

A secondary body member 30 is detachably attached to the rear face 25 of main body member 20. In the embodiment shown in FIGS. 12-16, secondary body member 30 extends over the entire rear face 25 of main body member 20. Thus, in this embodiment, secondary body member 30 extends from the heel side 15 of club head 100 to the toe side 16 of the club head, and further, extends from the crown portion 21 of main body member 20 to the sole portion 26 of main body member. Alternatively, secondary body member 30 may extend over only a portion of rear face 25.

Three fasteners 43*a*, 43*b* and 43*c* mechanically fasten secondary body member 30 to main body member 20. Fastener 43*a* is generally located adjacent the toe side 16 of club head 100 (see FIG. 15); fastener 43*b* is generally located in a central region of the rear side 12 of club head 100 (see FIGS. 13 and 14); and fastener 43*c* is generally located adjacent the heel side 15 of club head 100 (see FIG. 16). Secondary body member 30 may include through holes to accommodate fasteners 43*a*-43*c* (see FIG. 12(*b*)).

Figure 12B:
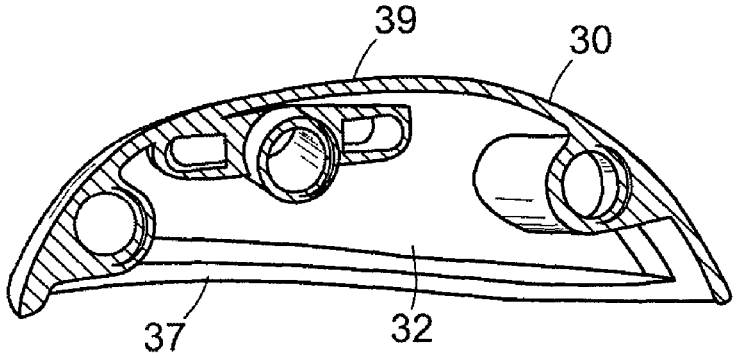
FIG. 12 is a perspective view of a golf club head in two parts according to yet another embodiment of the present invention, wherein (a) shows main body member 20 from a rear view perspective, and (b) shows secondary body member 30 removed from main body member 20 and rotated 180 degrees about a vertical axis.
Figure 12A:
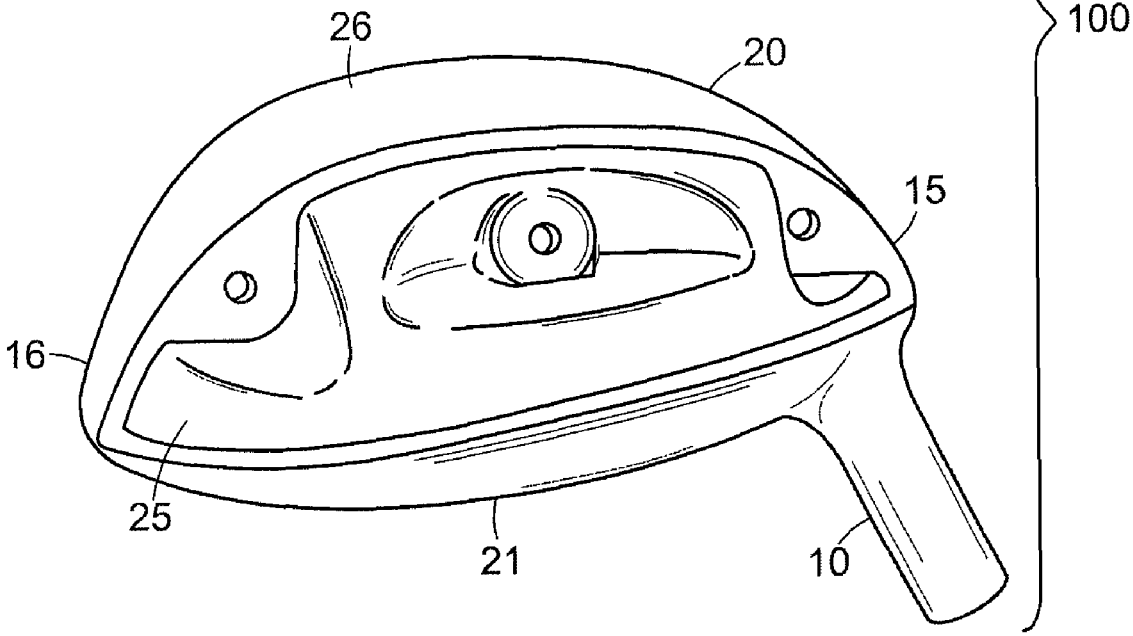

As best shown in FIG. 12(*a*), rear face 25 of main body member 20 need not be flat nor need it parallel the contour of striking surface 22. Rather, rear face 25 may be shaped or contoured to accommodate the attachment of secondary body member 30. Further, as best shown in FIGS. 13-16, main body member 20 may include corresponding bosses for receiving the threaded portions of fasteners 43*a*-43*c*.

In this embodiment, secondary body member 30 is shaped as a substantially shell-like structure such that an internal concavity 32 is defined therein. Thus, when secondary body member 30 is attached to main body member 20, an enclosed or a substantially enclosed secondary body cavity 38 is formed therebetween.

Optionally, rear face 25 may be contoured to complement a matching surface of secondary body member 30. If rear face 25 is contoured to complement a matching surface of secondary body member 30, then no secondary body cavity would be formed therebetween.

Figure 13:
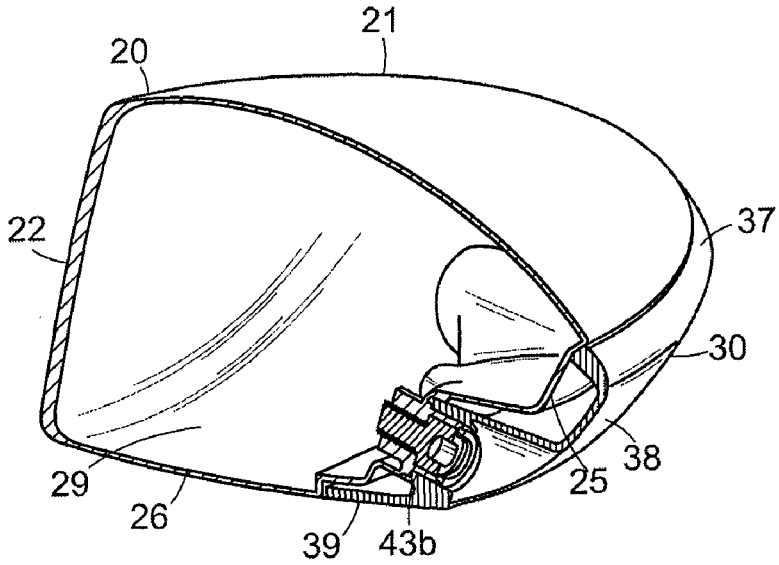
FIG. 13 is a cross-section perspective view of the golf club head according to the embodiment of FIG. 12.
Figure 14:
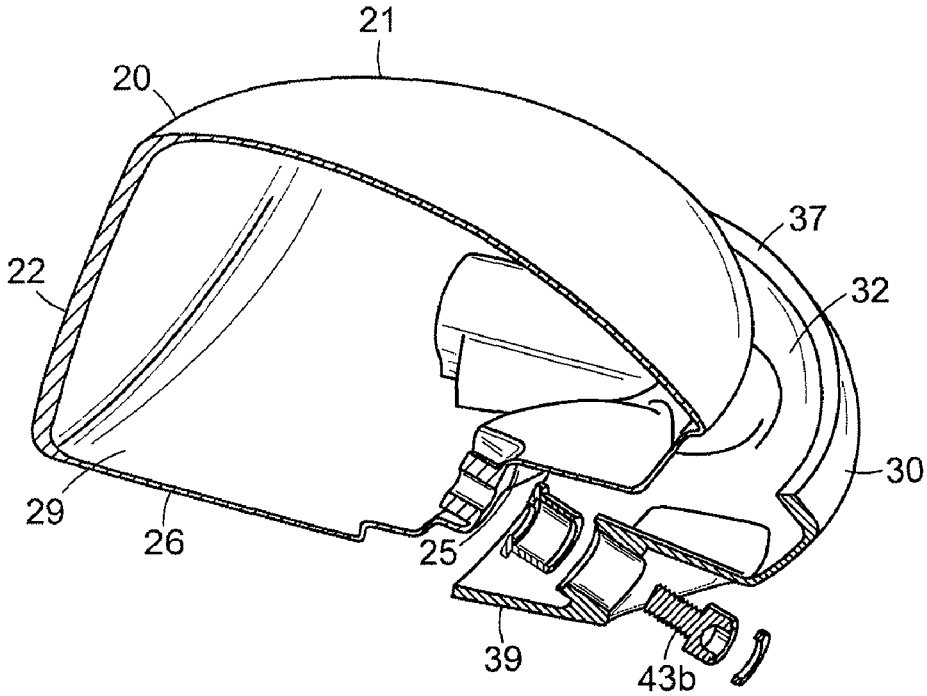
FIG. 14 is a cross-section, exploded, perspective view of the golf club head according to the embodiment of FIG. 12.
Figure 15:
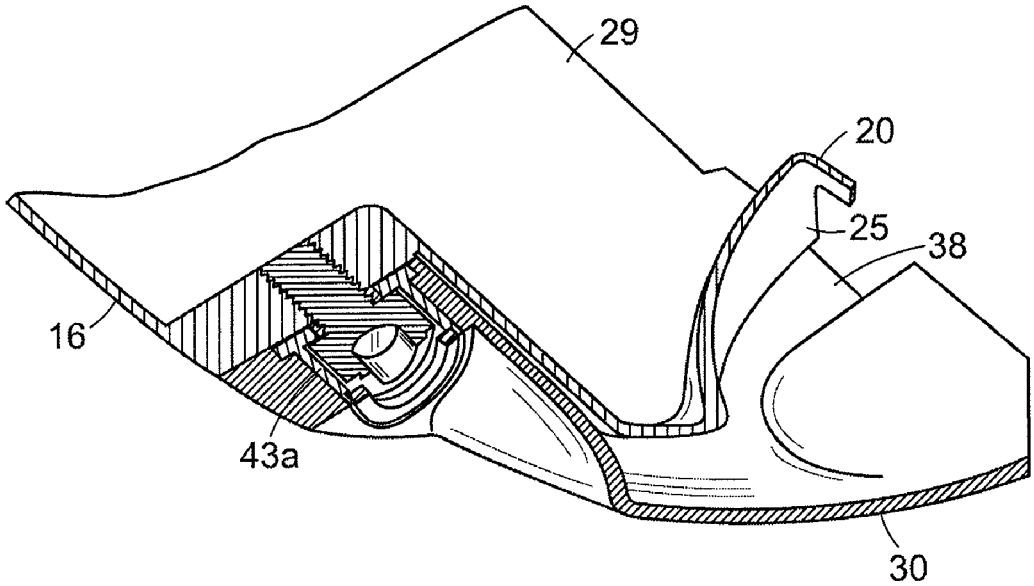
FIG. 15 is a cross-section perspective view of a toe portion of the golf club head according to the embodiment of FIG. 12.
Figure 16:
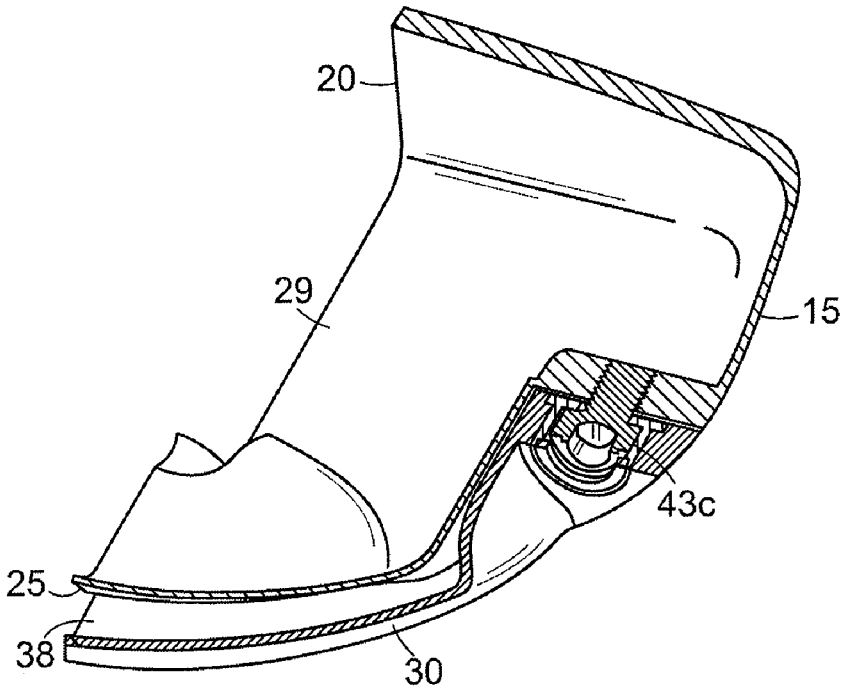
FIG. 16 is a cross-section perspective view of a heel portion of the golf club head according to the embodiment of FIG. 12.

As best shown in FIGS. 13 and 14, secondary body member 30 may include a crown portion 37 and a sole portion 39. The exterior surface of crown portion 37 of the secondary body member lies substantially flush with the exterior surface of crown portion 21 of the main body member. Similarly, the exterior surface of sole portion 39 of the secondary body member lies substantially flush with the exterior surface of sole portion 26 of the main body member.

Optionally, an adhesive, for example, a liquefying epoxy, may be applied to some or all of the complementary surfaces of secondary body member 30 and main body member 20. This adhesive may be applied in lieu of the mechanical fastening elements or in addition to the mechanical fastening elements.

Figure 17A:
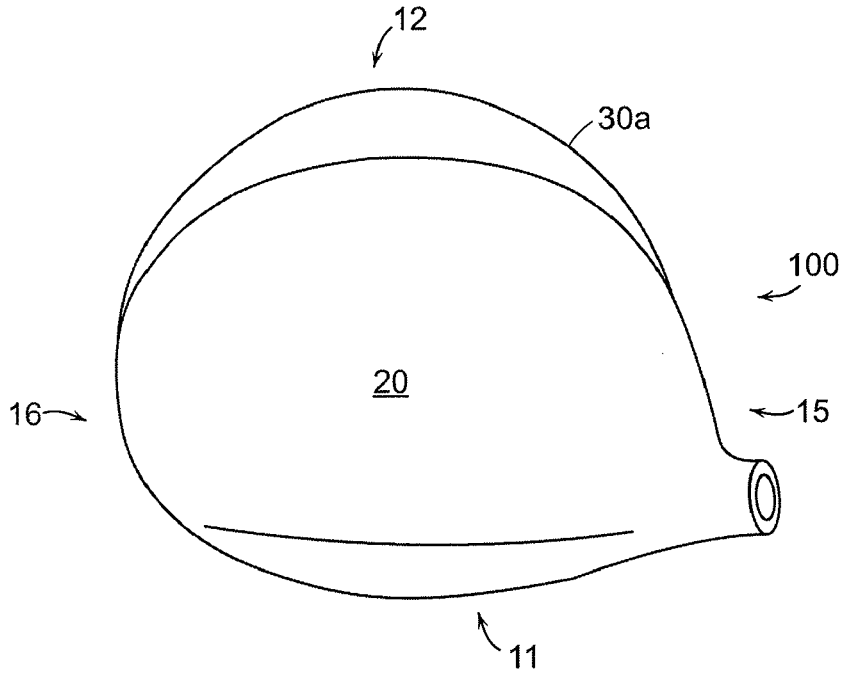
FIG. 17 is a top view of a two golf club heads according to another embodiment of the present invention, wherein (a) shows the rear body member 30*a* attached to front body member 20 and (b) shows a different rear body member 30*b* attached to the same front body member.
Figure 17B:
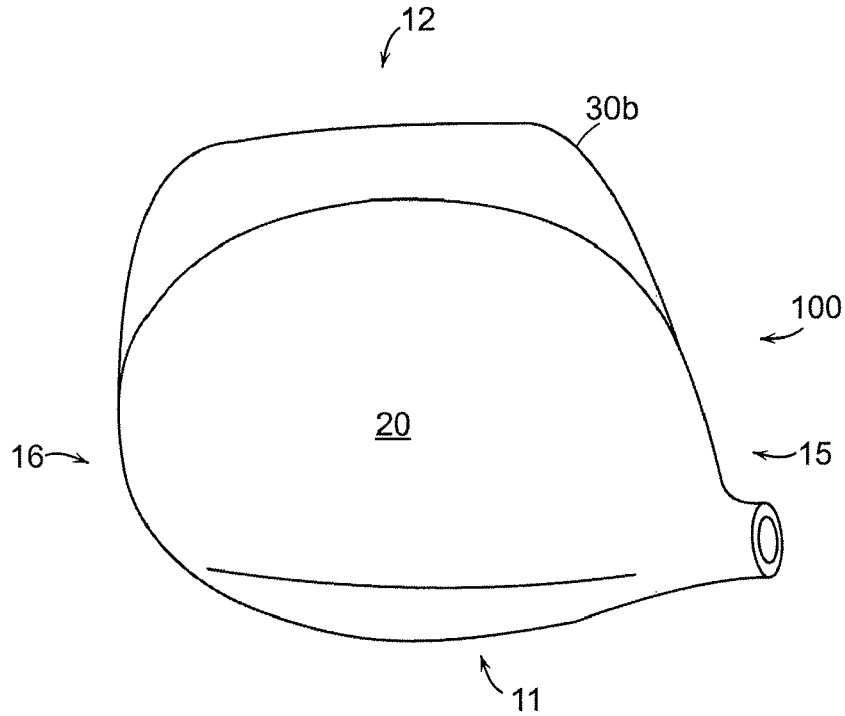
Figure 18:
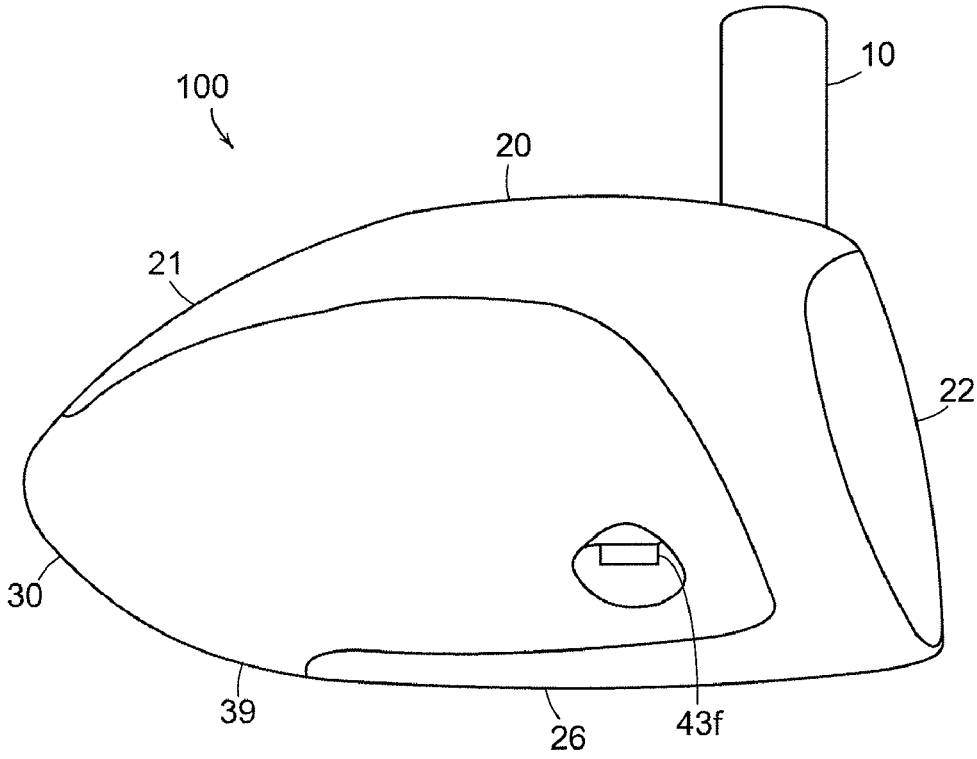
FIG. 18 is a toe side view of a golf club head according to a further embodiment of the present invention.

As shown in FIG. 17, in a golf club head system according to an embodiment of the invention, one or more rear or secondary body members 30 may be configured for interchangeable attachment to a front or main body member 20. A first rear body member 30*a* may be detachably attached to the front body member 20 (see FIG. 17(*a*)). At least one other rear body member 30*b* that is attachably interchangeable with the first rear body member 30*a* may be provided. When the first rear body member 30*a* is detached from front body member 20, the other rear body member 30*b* may be attached to front body member 20 in its stead (see FIG. 17(*b*)). Thus, either rear body member 30*a* or rear body member 30*b* may be interchangeably attached to front body member 20.

Rear body member 30*a* has different characteristics from rear body member 30*b*. For example, rear body member 30*a* has a difference external shape, a different center-of-gravity, and different moment-of-inertia characteristics, when compared to rear body member 30*b*. As shown in FIG. 17(*a*), rear body member 30*a* has a rounded rear surface, whereas as shown in FIG. 17(*b*), rear body member 30*b* has a more squared-off rear surface. As other examples, rear body members 30*a* and 30*b* may be formed of different materials or may have different finishes or looks. Other rear body members (not shown) with different characteristics may be provided for interchangeable attachment with front body member 20.

The system may further include the means for detachably attaching rear body members 30*a*, 30*b* to front body member 20. As presented above, such means could include mechanical fastening elements (such as, by way of non-limiting examples, threaded fasteners, elastically deformable elements, plastically deformable elements, tabs, pins, etc.) and/or adhesives (such as, by way of non-limiting example, a liquefying epoxy).

Figure 19:
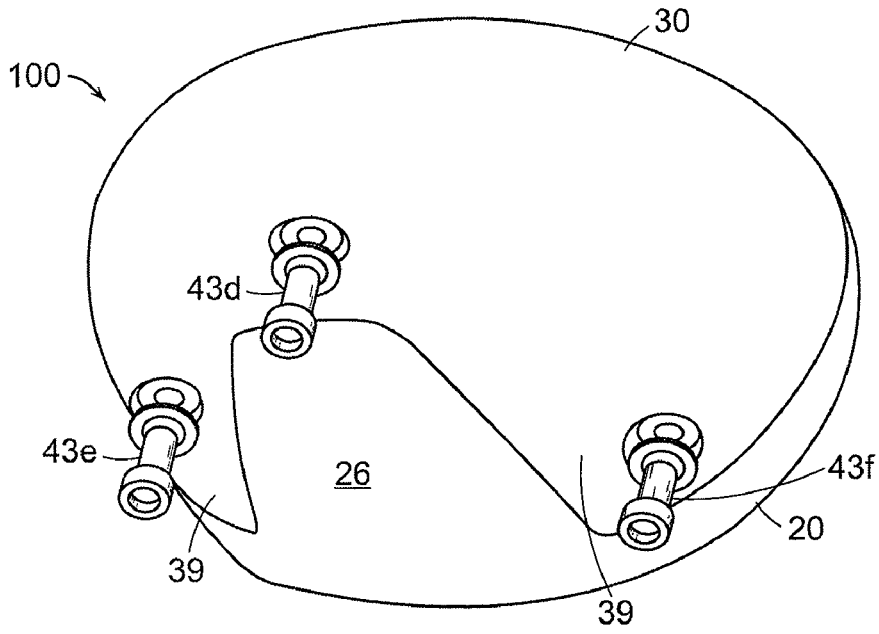
FIG. 19 is a perspective view of the bottom portion of the golf club head according to the embodiment of FIG. 18.

In an embodiment as shown in FIGS. 18 through 22, main body member 20 includes a striking surface 22, a sole portion 26, a crown portion 21, and a rear face 25 (see FIGS. 20 and 21) substantially opposed to striking surface 22. A secondary body member 30 is detachably attached to the rear face 25 of main body member 20. In the embodiment shown in FIGS. 18-22, secondary body member 30 extends over the entire rear face 25 of main body member 20 and over a portion of the sole of golf club head 100. As best shown in FIG. 19, portions of the exterior sole portion 39 of secondary body member 30 extend on either side of sole portion 26 of main body member 20.

Three fasteners 43*d*, 43*e* and 43*f* mechanically fasten secondary body member 30 to main body member 20. Fasteners 43*d*-43*f* generally extend perpendicular to sole portion 26, i.e., vertically when the club is in the striking position. Although three fasteners are shown, fewer or more fasteners may be used to attach secondary body member 30 to main body member 20.

Figure 20:
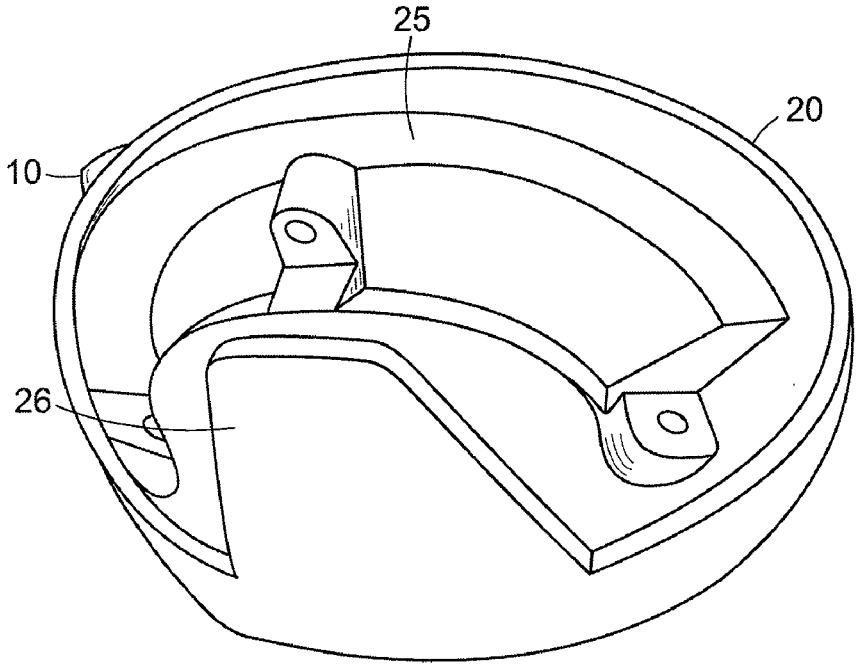
FIG. 20 is a perspective view of the bottom portion of the golf club head, with the secondary body member removed, according to the embodiment of FIG. 18.
Figure 21:
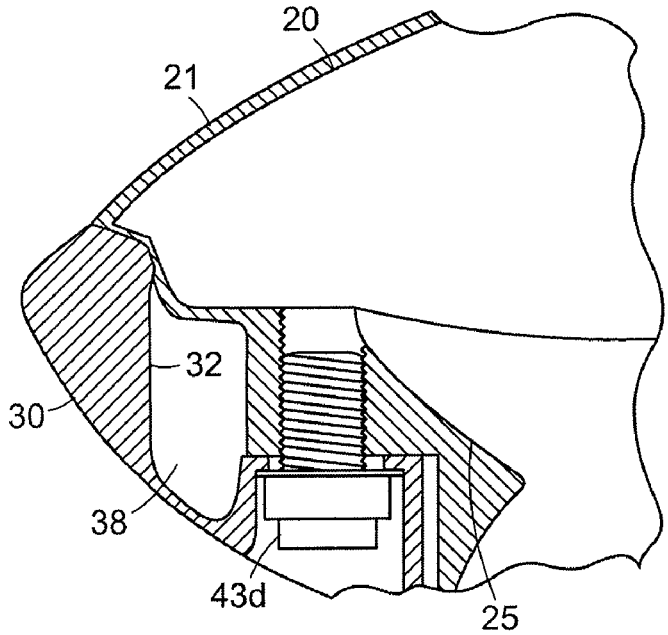
FIG. 21 is a cross-section side view of a rear portion of the gold club head according to the embodiment of FIG. 18.

As shown in FIG. 20, rear face 25 may be shaped or contoured to accommodate the attachment of secondary body member 30, for example, rear face 25 may include bosses for accommodating fasteners 43*d*-43*f*. In this embodiment, secondary body member 30 is also shaped as a substantially shell-like structure such that an internal concavity 32 is defined therein. Thus, when secondary body member 30 is attached to main body member 20, an enclosed or a substantially enclosed secondary body cavity 38 is formed therebetween.

Transformable or convertible club heads of the types described herein may be used in conjunction with hosel members having releasable connections to golf club shafts and/or in conjunction with hosel members that allow adjustment of various club head characteristics (e.g., adjustment of lie angle, loft angle, or face angle, e.g., by adjusting the relative positioning of the shaft with respect to the hosel). Any desired releasable and/or adjustable club head/shaft connection structures may be used without departing from this invention, including such connection structures as are known, commercially available, and/or used in the art. As some more specific examples, club heads of the types described herein may be used in conjunction with the releasable and/or adjustable club head/shaft connection features described in U.S. Pat. No. 6,890,269, entitled "Temporary Golf Club Shaft-component Connection," issued to Burrows on May 10, 2005; U.S. Published Patent Appln. No. 2005/0049072, entitled "Temporary Golf Club Shaft-component Connection," filed by Burrows on Sep. 30, 2004; U.S. patent application. Ser. No. 11/774,513, entitled "Releasable and Interchangeable Connections for Golf Club Heads and Shafts," filed in the name of Tavares et al. on Jul. 6, 2007; U.S. patent application Ser. No. 11/774,519, entitled "Releasable and Interchangeable Connections for Golf Club Heads and Shafts," filed in the name of Thomas et al. on Jul. 6, 2007; U.S. patent application Ser. No. 11/774,522, entitled "Releasable and Interchangeable Connections for Golf Club Heads and Shafts," filed in the name of Stites et al. on Jul. 6, 2007; U.S. patent application Ser. No. 11/846,370, entitled "Releasable and Interchangeable Connections for Golf Club Heads and Shafts," filed in the name of Stites et al. on Aug. 28, 2007; and U.S. patent application Ser. No. 12/177,778, entitled "Releasable and Interchangeable Connections for Golf Club Heads and Shafts," filed in the name of Thomas et al. on Jul. 22, 2008. Each of these patents, publications, and pending applications is entirely incorporated herein by reference.

The system may be used to provide an additional degree of individual golf club tailoring beyond what would otherwise be obtainable with known systems. For example, a golfer could easily test out multiple golf club head configurations in the shop prior to purchasing a customized club. Further, a golfer could also opt to purchase or take home more than one detachably interchangeable rear or secondary body member, thus having the readily available option of transforming or tailoring his or her golf club for different players, for different courses, for different weather conditions, for practicing different swing styles, etc. Retailers could market these easily transformable golf club heads, when sold with more than one detachably interchangeable body member, as two-for-one specials, as a cost effective way to own multiple customized club configurations, as a cost effective way to keep up with the latest golf technology by merely updating the interchangeable members, etc.

As an additional customizing option, specific body members could be produced that match (or are associated with) the characteristics or specifications of the clubs used by professional golfers or other celebrities. Retailers could thus afford consumers an opportunity to test out a club having characteristics similar to the club used by the consumer's favorite celebrity golfer. Further, retailers could promote the sales of the customizable club heads by including the interchangeable body member associated with the celebrity golfer for free (or at a reduced price), when one or more other interchangeable body members are purchased by the consumer.

In operation, the previously described features, individually and/or in any combination, improve the ability to customize and subsequently modify the mass characteristics of a golf club for any individual golfer. Golf clubs having customized mass characteristics are meant to improve a golfer's swing control and swing compensation. While the various features of golf club head 100 work together to achieve the advantages previously described, it is recognized that individual features and sub-combinations of these features can be used to obtain some of the aforementioned advantages without the necessity to adopt all of these features.

D. CONCLUSION

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims. All such modifications and adaptations are intended to be covered by the following claims.

What is claimed is:

1. A golf club head comprising:

a main body member having a striking surface, a sole portion, a crown portion, and a rear face opposed to the striking surface, the main body member defining an enclosed main body cavity, and a secondary body member attached to the main body member and extending over the entire rear face of the main body member, wherein the main body member is larger than the secondary body member, wherein the secondary body member defines a rear edge of the club head and a majority of the secondary body member is located below the rear edge, and wherein a secondary body member cavity is defined between the main body member and the secondary body member.

2. The golf club head of claim 1, wherein the secondary body member is detachably attached to the main body member with a plurality of mechanical elements.

3. The golf club head of claim 1, wherein the secondary body member is detachably attached to the main body member with an adhesive.

4. The golf club head according to claim 3, wherein the adhesive is an epoxy adhesive having a debonding temperature less than 200° C.

5. The golf club head according to claim 1, wherein the secondary body member is mechanically and adhesively detachably attached to the main body member.

6. The golf club head according to claim 1, wherein the secondary body member includes a sole portion.

7. The golf club head according to claim 1, wherein the secondary body member includes a crown portion.

8. A golf club head comprising:

a main body member having a striking surface and defining an enclosed main body cavity; and a secondary body member attached to the main body member, the secondary body member and the main body member defining an enclosed second cavity therebetween, wherein the main body member is larger than the secondary body member, wherein the secondary body member defines a rear edge of the club head and a majority of the secondary body member is located below the rear edge.

9. The golf club head according to claim 8, wherein the secondary body member is detachably attached to the main body member with a plurality of mechanical fastening elements.

10. The golf club head according to claim 8, wherein the secondary body member is detachably attached to the main body member with an adhesive.

11. The golf club head according to claim 10, wherein the adhesive is an epoxy adhesive having a debonding temperature less than 200° C.

12. The golf club head according to claim 8, wherein the secondary body member is mechanically and adhesively detachably attached to the main body member.

13. The golf club head according to claim 8, wherein the secondary body member includes a sole portion.

14. The golf club head of claim 8, wherein the main body member includes a heel side and a toe side, and wherein the secondary body member extends from the heel side to the toe side.

15. The golf club head of claim 8, wherein the main body member includes a crown portion and a sole portion, and wherein the secondary body member extends from the crown portion to the sole portion of the main body member.

16. A golf club comprising:

a golf club shaft; and a golf club head including:

a main body member having a striking surface, a sole portion, a crown portion, and a rear face opposed to the striking surface, the main body member defining an enclosed main body cavity, and a secondary body member attached to the main body member and extending over the entire rear face of the main body member, wherein the main body member is larger than the secondary body member, wherein the secondary body member defines a rear edge of the club head and a majority of the secondary body member is located below the rear edge, and wherein a secondary body member cavity is defined between the main body member and the secondary body member.

17. A golf club head comprising:

a main body member having a striking surface, a sole portion, a crown portion, and a rear face opposed to the striking surface, the main body member defining an enclosed main body cavity, and a secondary body member attached to the main body member and extending over the entire rear face of the main body member, wherein the main body member is larger than the secondary body member, wherein the secondary body member includes a crown portion and a sole portion and the sole portion of the secondary body member has a greater surface area than the crown portion of the secondary body member, and wherein a secondary body member cavity is defined between the main body member and the secondary body member.

18. A golf club head comprising:

a main body member having a striking surface and the main body member, by itself, defining an enclosed first cavity; and a secondary body member attached to the main body member, the secondary body member and the main body member defining an enclosed second cavity therebetween, wherein the main body member is larger than the secondary body member, wherein the secondary body member includes a crown portion and a sole portion and the sole portion of the secondary body member has a greater surface area than the crown portion of the secondary body member.

19. A golf club comprising:

a golf club shaft; and a golf club head including:

a main body member having a striking surface and the main body member, by itself, defining an enclosed first cavity; and a secondary body member attached to the main body member, the secondary body member and the main body member defining an enclosed second cavity therebetween, wherein the main body member is larger than the secondary body member, wherein the secondary body member defines a rear edge of the club head and a majority of the secondary body member is located below the rear edge.

* * * * *